US006790574B2

(12) United States Patent
Abe et al.

(10) Patent No.: US 6,790,574 B2
(45) Date of Patent: Sep. 14, 2004

(54) ELECTROPHOTOGRAPHIC PHOTORECEPTOR

(75) Inventors: Katsumi Abe, Tsukuba (JP); Chieko Inayoshi, Tsukuba (JP); Masaki Ohkubo, Tsukuba (JP); Mitsutoshi Anzai, Tsukuba (JP); Yasuo Murakami, Tsukuba (JP)

(73) Assignee: Hodogaya Chemical Co., Ltd., Kawasaki (JP)

( * ) Notice: Subject to any disclaimer, the term of this patent is extended or adjusted under 35 U.S.C. 154(b) by 113 days.

(21) Appl. No.: 10/254,937

(22) Filed: Sep. 26, 2002

(65) Prior Publication Data

US 2003/0203298 A1 Oct. 30, 2003

(30) Foreign Application Priority Data

Sep. 27, 2001 (JP) ..... 2001-297317
Oct. 30, 2001 (JP) ..... 2001-333180

(51) Int. Cl.[7] ..... G03G 15/06
(52) U.S. Cl. ..... 430/72; 430/83; 430/58.65
(58) Field of Search ..... 430/72, 83, 58.65

(56) References Cited

U.S. PATENT DOCUMENTS 5,728,500 A 3/1998 Takesue et al.

FOREIGN PATENT DOCUMENTS

JP 64-44946 2/1989
JP 1-118845 5/1989
JP 9-328456 12/1997
JP 10-148952 6/1998

*Primary Examiner*—Mark A. Chapman
(74) *Attorney, Agent, or Firm*—Oblon, Spivak, McClelland, Maier & Neustadt, P.C.

(57) ABSTRACT

An electrophotographic photoreceptor having a photosensitive layer containing, as a charge transporting material, at least one indane compound of the formula (1), (1)

and at least one polycarbonate resin of the formula (4)

(4)

and/or an organic additive containing at least one atom selected from the group consisting of nitrogen, oxygen, phosphorus and sulfur for an electrophotographic photoreceptor.

8 Claims, 3 Drawing Sheets

ELECTROPHOTOGRAPHIC PHOTORECEPTOR

BACKGROUND OF THE INVENTION

1. Field of the Invention

The present invention relates to an electrophotographic photoreceptor. Particularly, the present invention relates to an electrophotographic photoreceptor having a high sensitivity and an excellent durability. Also, the present invention relates to an electrophotographic photoreceptor having an excellent durability, which causes less change in charge potential and residual potential even after being repeatedly used.

2. Discussion of Background Art

Heretofore, an inorganic photoconductive material such as selenium, zinc oxide, cadmium sulfide and silicon has been widely used as an electrophotographic photoreceptor. These inorganic materials have many merits and also have various demerits. For example, selenium requires hard production conditions and is easily crystallized by heat or a mechanical impact. Zinc oxide and cadmium sulfide have problems in moisture resistance and mechanical strength, and become poor in charging and exposing properties depending on a dye added as a sensitizer, and have a disadvantage in durability. Also, silicon requires hard production conditions and takes a high cost since a stimulative gas is used, and it is hard to handle it since it is sensitive to humidity. Further, selenium and cadmium sulfide have poisonous problems.

Recently, in order to overcome the disadvantages of these inorganic photosensitive materials, organic photosensitive materials using various organic compounds have been studied and widely used. Organic photosensitive materials include a monolayered photoreceptor having a charge generating agent and a charge transporting agent dispersed in a binder resin and a multilayered photoreceptor having a charge generating layer and a charge transporting layer separately provided to separately achieve functions. The photoreceptor referred to as "function-separating type" has such advantages that various materials can be widely selected so as to be suitable for each function and that a photoreceptor having an optional performance can be easily prepared, and accordingly many studies have been made.

As mentioned above, in order to satisfy requirements of a high durability and a basic performance demanded for an electrophotographic photoreceptor, development of novel materials and their combinations has been made and various improvements have been made, but satisfactory materials can not have been provided up to now.

As one of the above-mentioned examples, it is generally known that a kind of binder resins provide an influence on film properties and electrophotographic properties of an electrophotographic photoreceptor when an electrophotographic photoreceptor is produced by changing various binder resins to a specific charge transporting agent. For example, when an electrophotographic photoreceptor is produced by using polystyrene resin as a binder resin to a stilbene type charge transporting agent, electrophotographic properties including a drift mobility or a sensitivity are improved, but a film becomes weak or brittle and film properties are lowered. Also, when an electrophotographic photoreceptor is produced by using acrylic acid ester resin as a binder resin, film properties become satisfactory but electrophotographic properties are lowered.

However, although an organic material has many advantages which are not possessed by an inorganic material, but an organic material satisfying all of properties required for an electrophotographic photoreceptor has not been developed up to now. Thus, by repeatedly using, image qualities are deteriorated due to lowering of a charge potential, rising of a residual potential and a change in sensitivity. The causes of these deteriorations are not completely analyzed, but the deteriorations are considered to be caused by ozone generated by corona discharge at the time of charging, an active gas such as NOX, light exposure, ultraviolet rays included in destaticizing light or heat which causes decomposition of a charge transporting agent. In order to prevent the deteriorations, JP-A-1-44946 proposes to combine a hydrazone compound and an antioxidant, and JP-A-1-118845 proposes to combine a butadiene compound and an antioxidant, but a product having a satisfactory initial sensitivity is not sufficiently improved in respect of preventing the deterioration caused by repeated use and a product having less deterioration due to repeated use is poor in respect of initial sensitivity and charging properties. Thus, these conventional techniques have not achieved satisfactory effects up to now.

Accordingly, an object of the present invention is to provide an electrophotographic photoreceptor having a high sensitivity and a low residual potential in the initial stage, which is stable to ozone, light, heat and the like and is not deteriorated by fatigue even by repeatedly using.

Also, the present inventors have intensively studied an electrophotographic photoreceptor excellent in sensitivity and durability, and have discovered that an electrophotographic photoreceptor containing an indane compound and a polycarbonate resin provides excellent sensitivity and durability. Thus, an object of the present invention is to provide an electrophotographic photoreceptor having improved electrophotographic properties including sensitivity and residual potential and also having an excellent durability by combining an indane compound and a polycarbonate resin.

SUMMARY OF THE INVENTION

The present invention resides in an electrophotographic photoreceptor having at least one indane compound of the following formula (1) and at least one polycarbonate resin of the following formula (4) in a weight ratio of from 2:8 to 7:3 on an electroconductive support;

said at least one indane compound being expressed by the formula (1), (1)

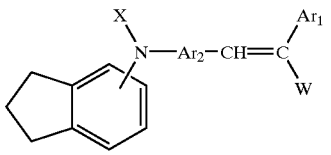

(wherein Ar1 is a substituted or unsubstituted aryl group, Ar2 is a substituted or unsubstituted phenylene group, a substituted or unsubstituted naphthylene group, a substituted or unsubstituted biphenylene group or a substituted or unsubstituted anthrylene group, W is a hydrogen atom, a substituted or unsubstituted alkyl group or a substituted or unsubstituted aryl group, X is a substituted or unsubstituted aryl group, a monovalent group of the formula (2), (2)

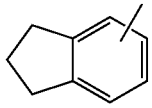

or a monovalent group of the formula (3), (3)

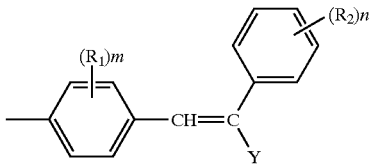

(wherein R1 is a hydrogen atom, a lower alkyl group or a lower alkoxy group, R2 is a hydrogen atom, a halogen atom or a lower alkyl group, Y is a hydrogen atom or a substituted or unsubstituted aryl group, and m and n are an integer of from 0 to 4)), and said at least one polycarbonate resin being expressed by the formula (4), (4)

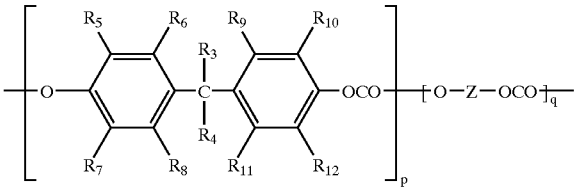

(wherein R3 and R4 are respectively independently a hydrogen atom, a substituted or unsubstituted alkyl group or a substituted or unsubstituted aryl group, R3 and R4 together may form a ring, R5, R6, R7, R8, R9, R10, R11 and R12 are respectively independently a hydrogen atom, a substituted or unsubstituted alkyl group, a substituted or unsubstituted aryl group or a halogen atom, p is a positive integer, q is 0 or a positive integer, p and q satisfy the formula $0 \leqq q/p \leqq 2$, Z is a substituted or unsubstituted $C_1$–$C_5$ alkylene group, a substituted or unsubstituted 4,4'-biphenylene group or a divalent group of the formula (5), (5)

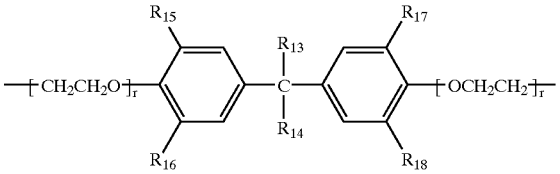

(wherein R13 and R14 are respectively independently a hydrogen atom, a substituted or unsubstituted alkyl group or a substituted or unsubstituted aryl group, R13 and R14 together may form a ring, R15, R16, R17 and R18 are respectively independently a hydrogen atom, a substituted or unsubstituted alkyl group, a substituted or unsubstituted aryl group or a halogen atom, and r is 0 or an integer of from 1 to 3)).

However, when only one kind of polycarbonate resin is used in the above electrophotographic photoreceptor, the polycarbonate resin of the formula (4) does not have a structure wherein R3 and R4 are a methyl group, R5, R6, R7, R8, R9, R10, R11 and R12 are a hydrogen atom, and q is 0.

By using the electrophotographic photoreceptor of the present invention, electrophotographic properties such as sensitivity and residual potential can be improved and a high durability can be achieved.

Examples of a charge transporting agent of an indane compound expressed by the above formulae (1) to (3) are illustrated below.

(Charge transporting agent No. 1)

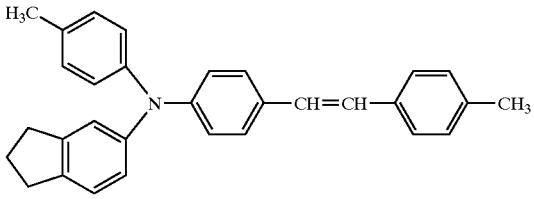

(Charge transporting agent No. 2)

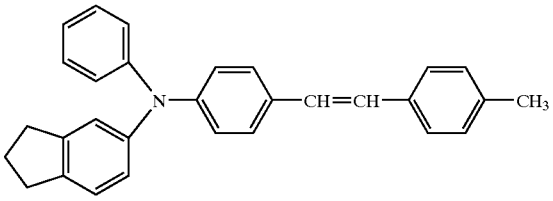

(Charge transporting agent No. 3)

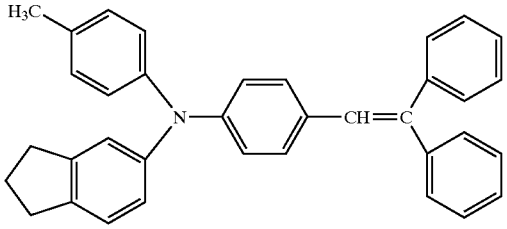

(Charge transporting agent No. 4)

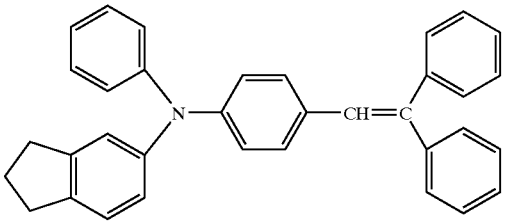

-continued
(Charge transporting agent No. 5)
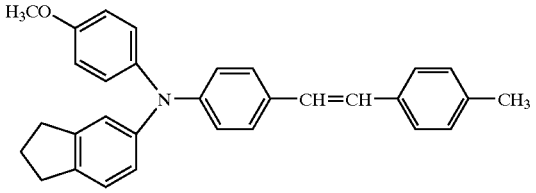
(Charge transporting agent No. 6)
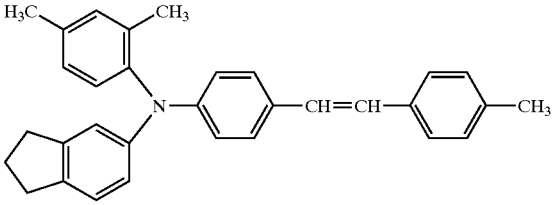
(Charge transporting agent No. 7)
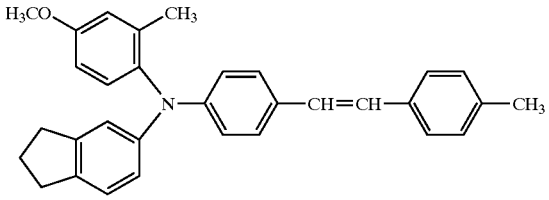
(Charge transporting agent No. 8)
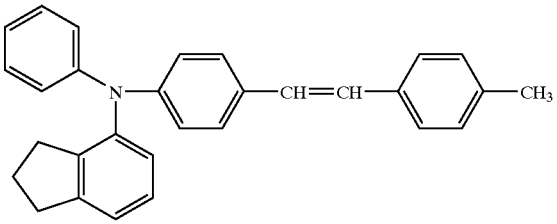
(Charge transporting agent No. 9)
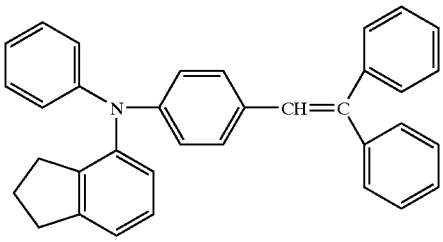
(Charge transporting agent No. 10)
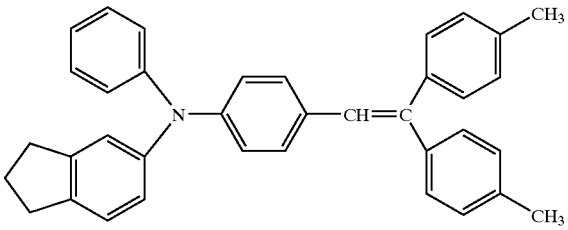
(Charge transportaing agent No. 11)
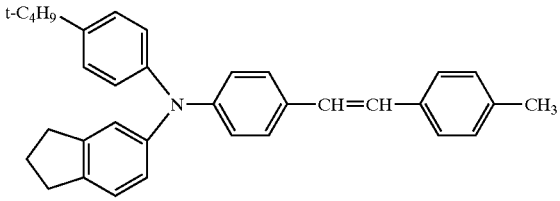
(Charge transportaing agent No. 12)
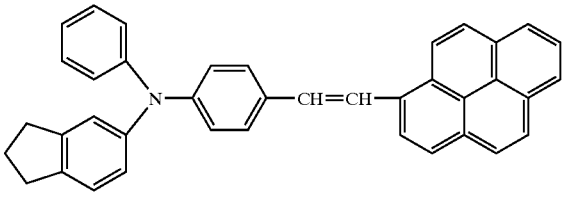
(Charge transporting agent No. 13)
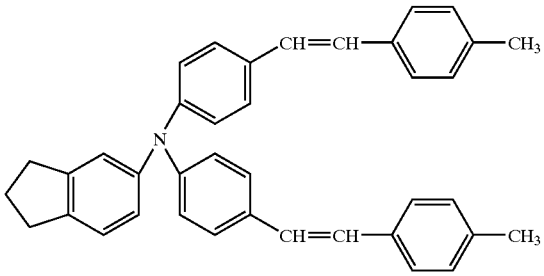
(Charge transporting agent No. 14)
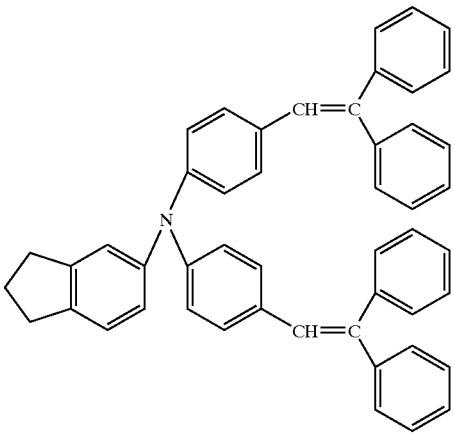

-continued
(Charge transporting agent No. 15)
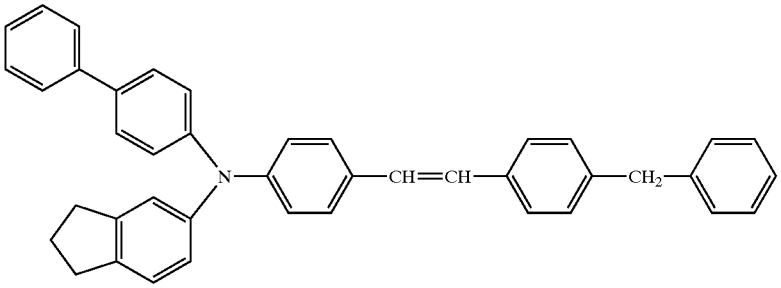
(Charge transporting agent No. 16)
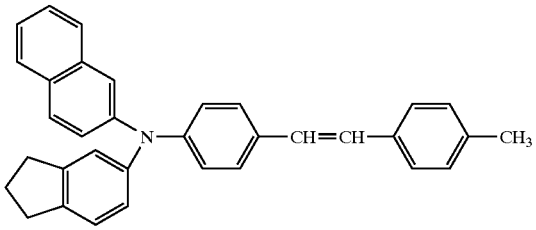
(Charge transporting agent No.17)
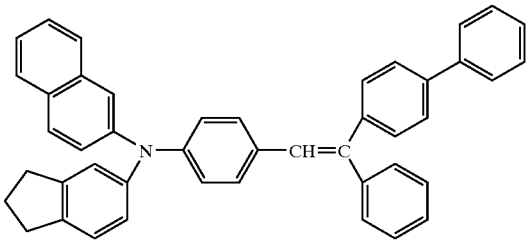
(Charge transporting agent No.18)
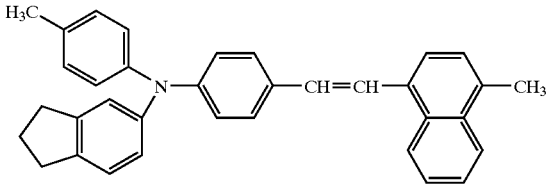
(Charge transporting agent No.19)
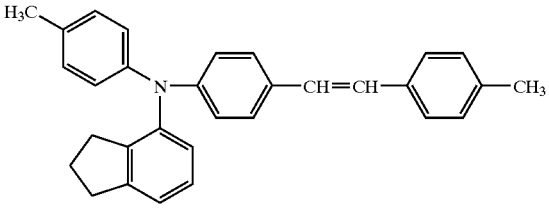
(Charge transporting agent No. 20)
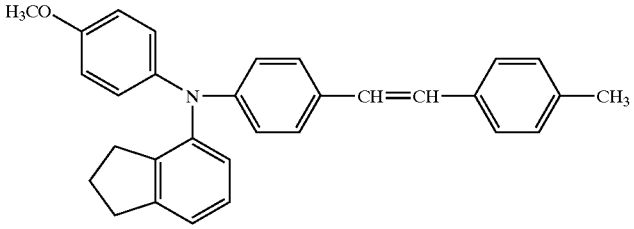
(Charge transporting agent No. 21)
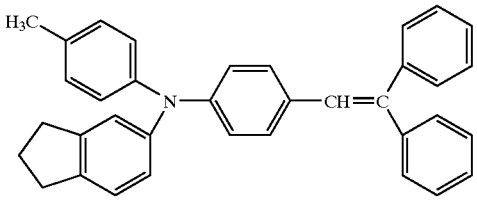
(Charge transporting agent No. 22)
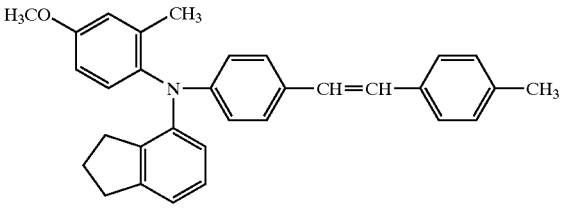
(Charge transporting agent No. 23)
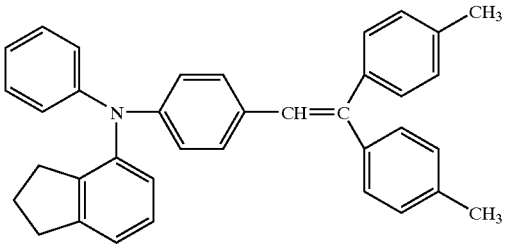

-continued (Charge transporting agent No. 24)

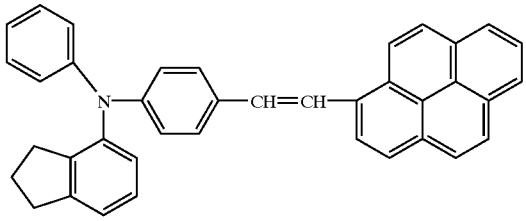

(Charge transporting agent No. 25)

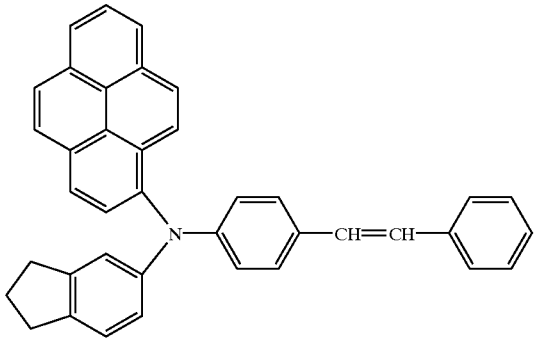

(Charge transporting agent No. 26)

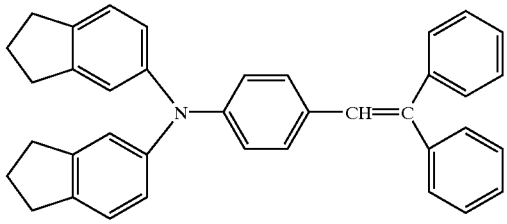

(Charge transporting agent No. 27)

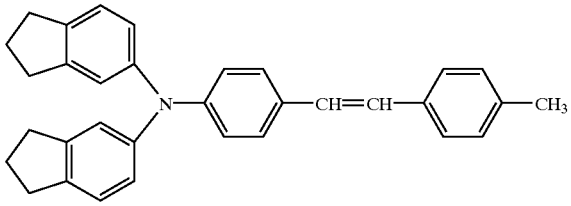

(Charge transporting agent No. 28)

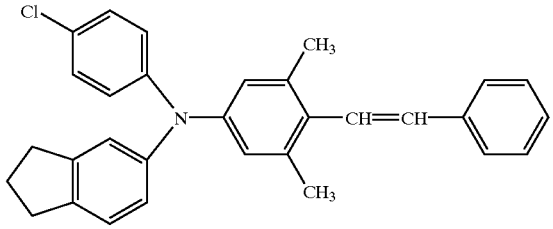

(Charge transporting agent No. 29)

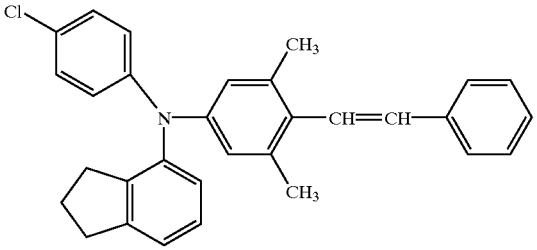

(Charge transporting agent No. 30)

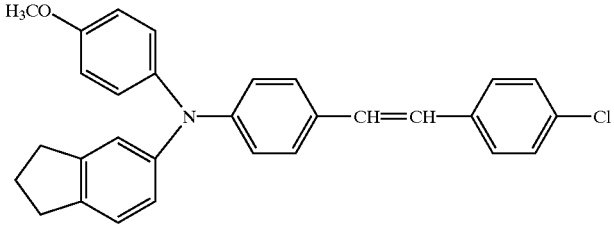

Examples of a polycarbonate resin expressed by the above formulae (4) to (5) are illustrated below, but the polycarbonate resin used in the present invention should not be limited thereto.

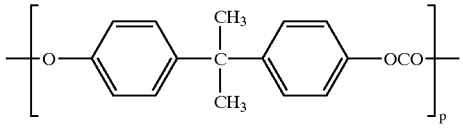

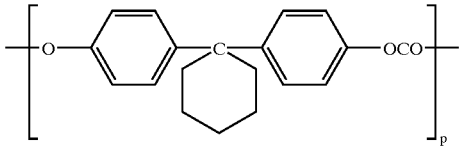

-continued
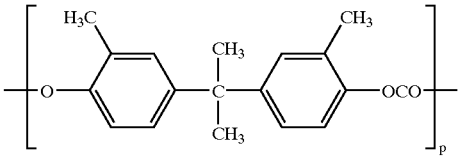
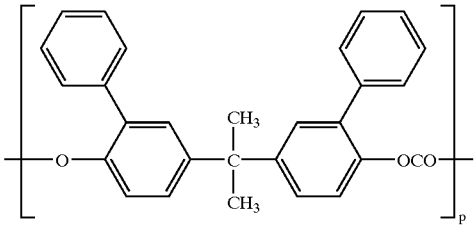
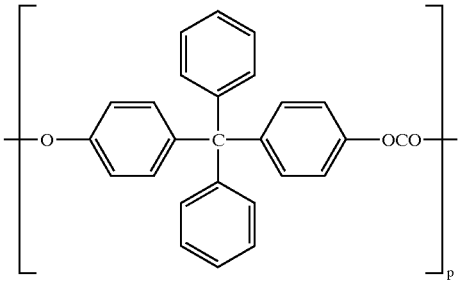
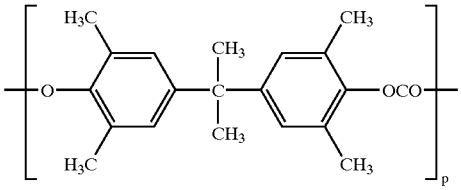
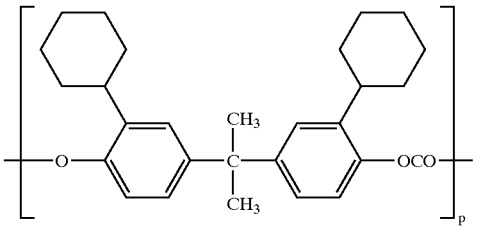
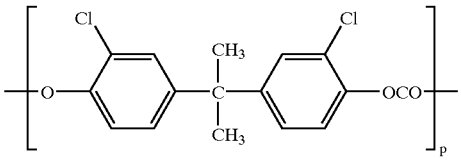
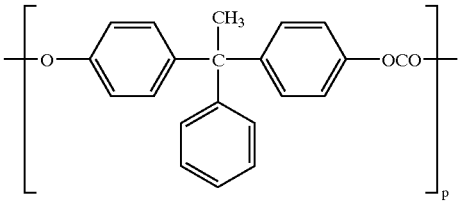
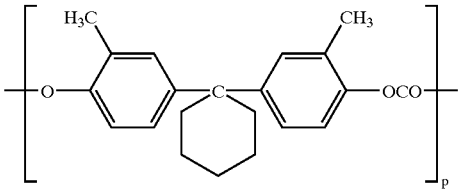
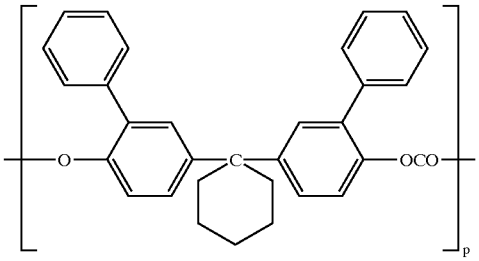
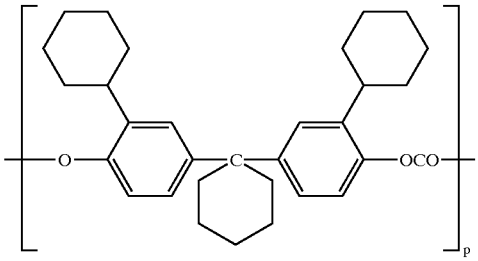
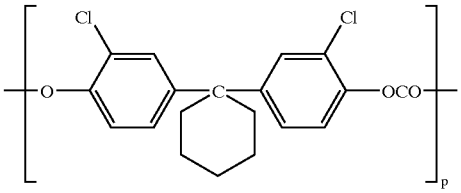
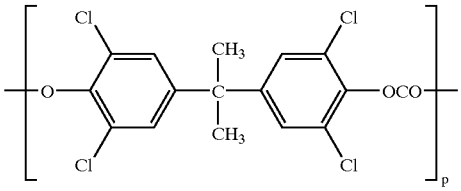
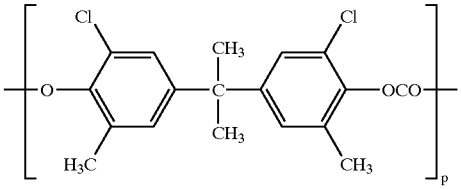
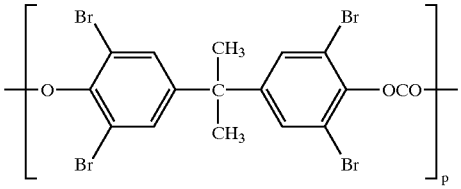

-continued

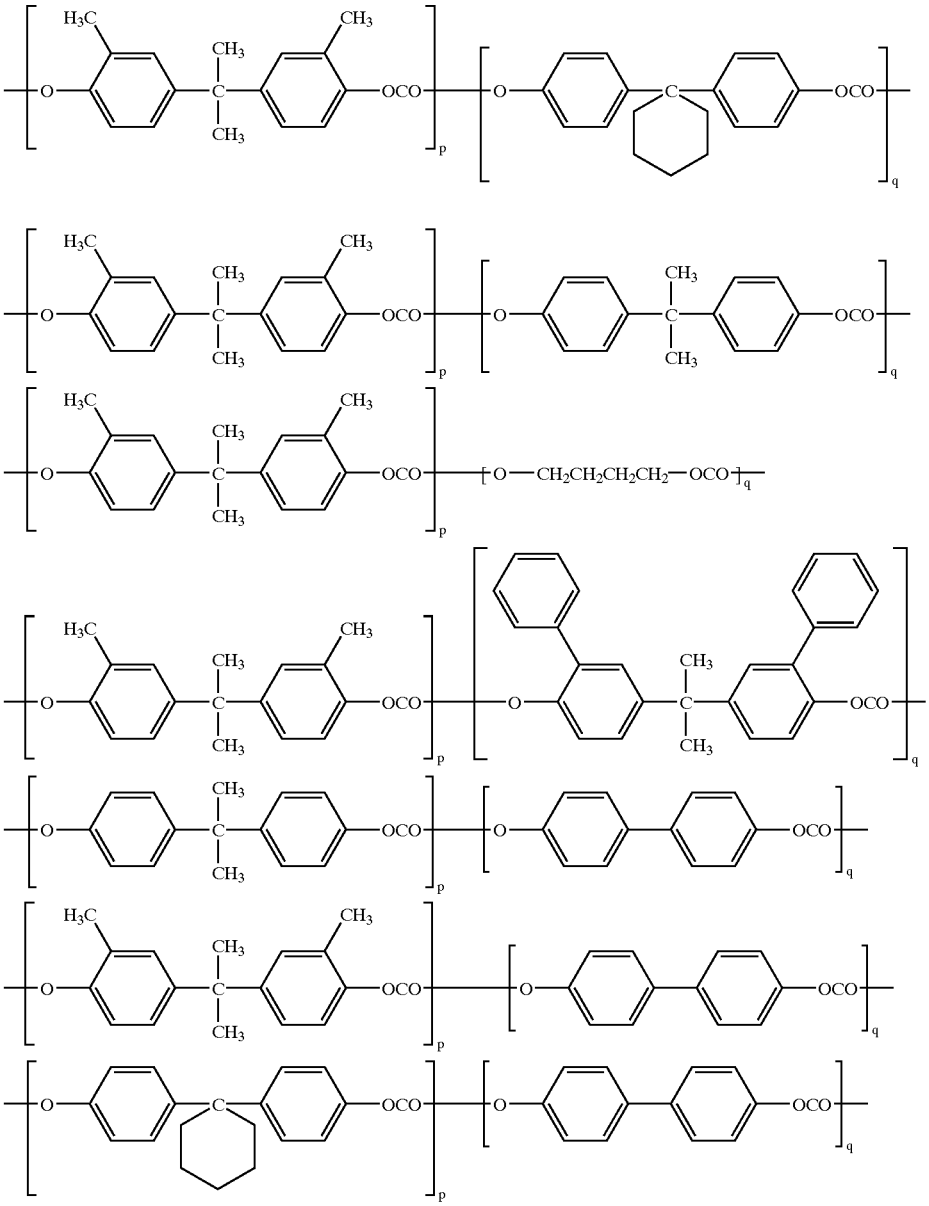

The electrophotographic photoreceptor of the present invention has a photosensitive layer containing said at least one indane compound and said at lest one polycarbonate resin.

Also, the present invention resides in an electrophotographic photoreceptor having a photosensitive layer containing at least one indane compound of the following formula (1) and an organic additive containing at least one atom selected from the group consisting of nitrogen, oxygen, phosphorus and sulfur for an electrophotographic photoreceptor on an electroconductive support;

said at least one indane compound being expressed by the formula (1),

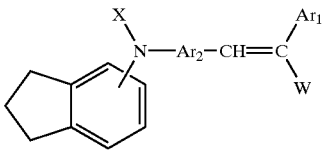

(1)

(wherein Ar1 is a substituted or unsubstituted aryl group, Ar2 is a substituted or unsubstituted phenylene group, a substituted or unsubstituted naphthylene group, a substituted or unsubstituted biphenylene group or a substituted or unsubstituted anthrylene group, W is a hydrogen atom, a substituted or unsubstituted alkyl group or a substituted or unsubstituted aryl group, X is a substituted or unsubstituted aryl group, a monovalent group of the formula (2), (2)

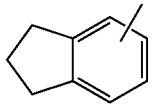

or a monovalent group of the formula (3), (3)

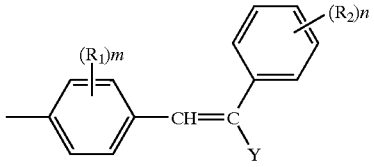

(wherein R1 is a hydrogen atom, a lower alkyl group or a lower alkoxy group, R2 is a hydrogen atom, a halogen atom or a lower alkyl group, Y is a hydrogen atom or a substituted or unsubstituted aryl group, and m and n are an integer of from 0 to 4)).

By having the above photosensitive layer, the electrophotographic photoreceptor of the present invention provides stable electrophotographic properties including satisfactory charge potential and residual potential and also provides a high durability.

Further, the present invention resides in an electrophotographic photoreceptor, wherein the above organic additive containing at least one atom selected from the group consisting of nitrogen, oxygen, phosphorus and sulfur for an electrophotographic photoreceptor is contained in an amount of from 0.05 to 30 wt % to the indane compound of the formulae (1) to (3);

the organic additive being at least one compound selected from the group consisting of an organic phosphite compound of the formula (6), (6)

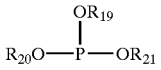

(wherein $R_{19}$, $R_{20}$ and $R_{21}$ may be the same or different, and are a hydrogen atom, a substituted or unsubstituted alkyl group, a substituted or unsubstituted alkenyl group, an allyl group or a substituted or unsubstituted aryl group, provided that $R_{19}$, $R_{20}$ and $R_{21}$ are not hydrogen atoms at the same time), a triphenylated phosphorus compound of the formula (7), (7)

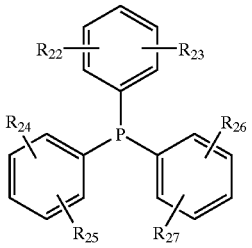

(wherein $R_{22}$, $R_{23}$, $R_{24}$, $R_{25}$, $R_{26}$ and $R_{27}$ may be the same or different, and are a hydrogen atom, a halogen atom, a hydroxyl group, an amino group or an alkyl group), a thioether compound of the formula (8), $$R_{28}—S—R_{29} \quad (8)$$

wherein $R_{28}$ and $R_{29}$ may be the same or different, and are a substituted or unsubstituted alkyl group, a substituted or unsubstituted alkenyl group, an allyl group or a substituted or unsubstituted aryl group), a hydroquinone compound of the formula (9), (9)

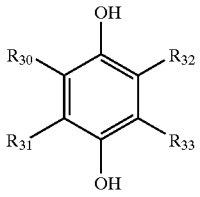

(wherein $R_{30}$, $R_{31}$, $R_{32}$ and $R_{33}$ may be the same or different, and are a hydrogen atom, a substituted or unsubstituted alkyl group, a substituted or unsubstituted alkenyl group, an allyl group or a substituted or unsubstituted aryl group), a benzotriazole compound of the formula (10), (10)

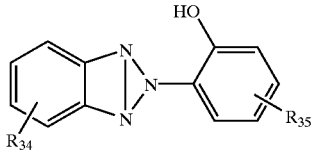

(wherein $R_{34}$ and $R_{35}$ may be the same or different, and are a hydrogen atom, a substituted or unsubstituted alkyl group, a substituted or unsubstituted alkenyl group, an allyl group or a substituted or unsubstituted aryl group), a benzotriazole-alkylenebisphenol compound of the formula (11), (11)

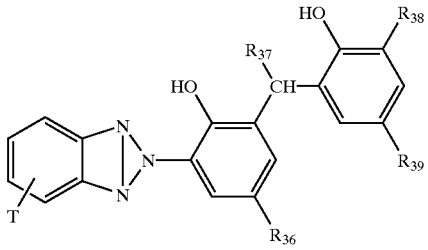

(wherein T is a hydrogen atom, a halogen atom, an alkyl group, a cycloalkyl group, an alkoxy group or an aralkyl group, $R_{36}$ is an alkyl group, a cycloalkyl group, an aryl group, an alkoxy group or an aralkyl group, $R_{37}$ is a hydrogen atom, an alkyl group or an aryl group, $R_{38}$ and $R_{39}$ may be the same or different and are an alkyl group, a cycloalkyl group, an aryl group or an aralkyl group), a hydroxybenzophenone compound of the formula (12), (12)

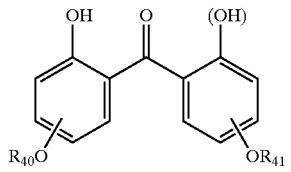

(wherein $R_{40}$ and $R_{41}$ may be the same or different, and are a hydrogen atom, a substituted or unsubstituted alkyl group, a substituted or unsubstituted alkenyl group, an allyl group or a substituted or unsubstituted aryl group), hindered phenol compounds of the formulae (13) and (14), (13)

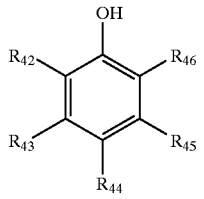

(wherein $R_{42}$ is a lower alkyl group, $R_{43}$, $R_{44}$, $R_{45}$ and $R_{46}$ may be the same or different, and are a hydrogen atom, a substituted or unsubstituted lower alkyl group or a substituted or unsubstituted lower alkoxy group), (14)

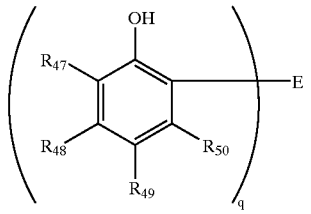

(wherein $R_{47}$ is a lower alkyl group, $R_{48}$, $R_{49}$ and $R_{50}$ may be the same or different, and are a hydrogen atom, a substituted or unsubstituted lower alkyl group or a substituted or unsubstituted lower alkoxy group, q is an integer of from 2 to 4, E is an oxygen atom or an aliphatic divalent group when q=2 and is an aliphatic trivalent group or an aromatic trivalent group when q=3, and an aliphatic tetravalent group when q=4), a hindered amine compound of the formula (15), (15)

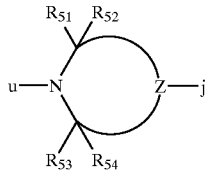

(wherein $R_{51}$, $R_{52}$, $R_{53}$ and $R_{54}$ may be the same or different, and are a hydrogen atom, a substituted or unsubstituted alkyl group or a substituted or unsubstituted aryl group, Z is a group of atoms necessary for forming a nitrogen-containing heterocyclic ring, and one of a pair of $R_{51}$ and $R_{52}$ and a pair of $R_{53}$ and $R_{54}$ may form a double bond within Z, and u and j are organic residues), and a salicylate compound of the formula (16), (16)

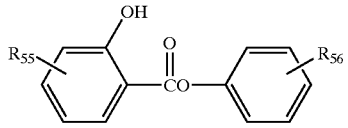

(wherein $R_{55}$ and $R_{56}$ may be the same or different, and are a hydrogen atom, a substituted or unsubstituted alkyl group, a substituted or unsubstituted alkenyl group, an allyl group or a substituted or unsubstituted aryl group).

The electrophotographic photoreceptor of the present invention has a photosensitive layer containing at least one indane compound and at least one organic additive (hereinafter referred to as "additive") containing at least one atom selected from the group consisting of nitrogen, oxygen, phosphorus and sulfur.

Examples of a charge transporting agent of an indane compound expressed by the formulae (1) to (3) are illustrated above.

EXPLANATION OF REFERENCE NUMERALS

1 represents an electroconductive support;
2 represents a charge generating layer;
3 represents a charge transporting layer;
4 represents a photosensitive layer;
5 represents an undercoat layer;
6 represents a charge transporting material-containing layer;
7 represents a charge generating material; and
8 represents a protective layer.

DETAILED DESCRIPTION OF THE PREFERRED EMBODIMENT

There are various forms of a photosensitive layer, but the electrophotographic photoreceptor of the present invention may take any of these photosensitive layers. Typical examples of the photoreceptor are illustrated in FIGS. 1 to 7.

Figure 1:
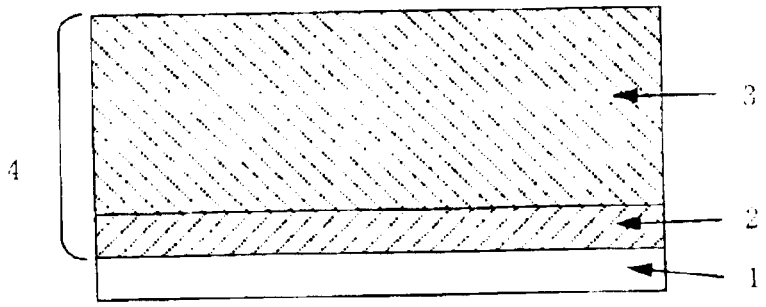
FIG. 1 is a sectional view illustrating a layer structure of a function-separation type electrophotographic photoreceptor.
Figure 2:
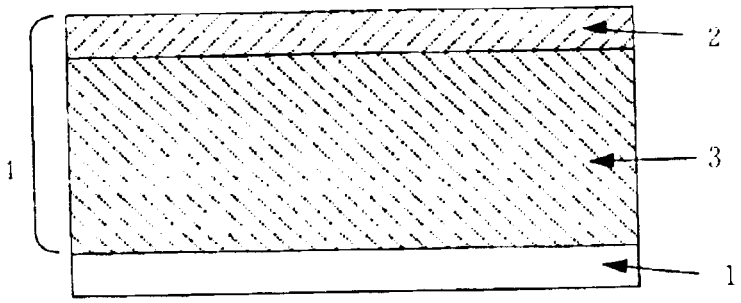
FIG. 2 is a sectional view illustrating another layer structure of a function-separation type electrophotographic photoreceptor.
Figure 3:
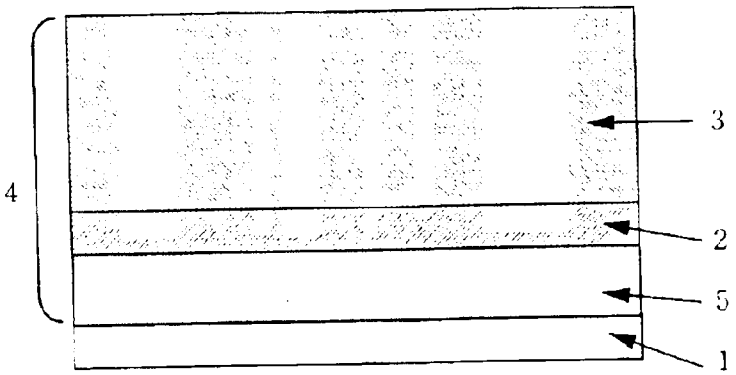
FIG. 3 is a sectional view illustrating a layer structure of a function-separation type electrophotographic photoreceptor, in which an undercoat layer is provided between a charge generating layer and an electroconductive support.
Figure 4:
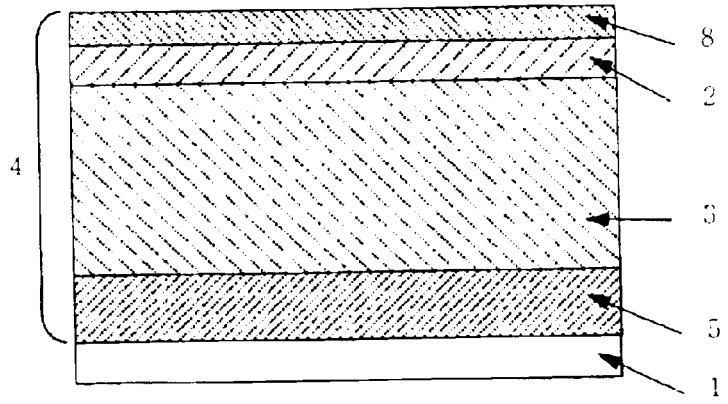
FIG. 4 is a sectional view illustrating a layer structure of a function-separation type electrophotographic photoreceptor, in which an undercoat layer is provided between a charge transporting layer and an electroconductive support and also a protective layer is provided on a charge generating layer.
Figure 5:
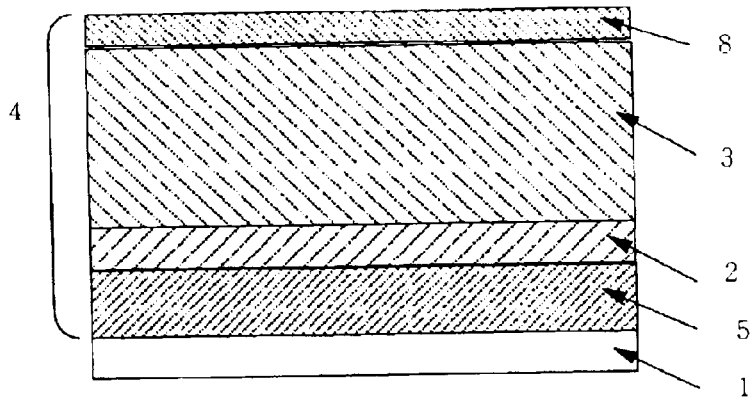
FIG. 5 is a sectional view illustrating a layer structure of a function-separation type electrophotographic photoreceptor, in which an undercoat layer is provided between a charge generating layer and an electroconductive support and also a protective layer is provided on a charge transporting layer.
Figure 6:
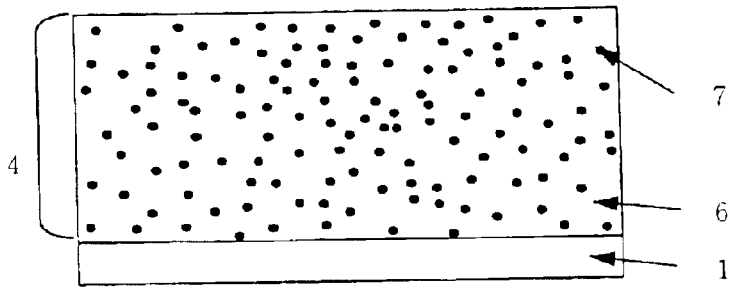
FIG. 6 is a sectional view illustrating a layer structure of a monolayer type electrophotographic photoreceptor.
Figure 7:
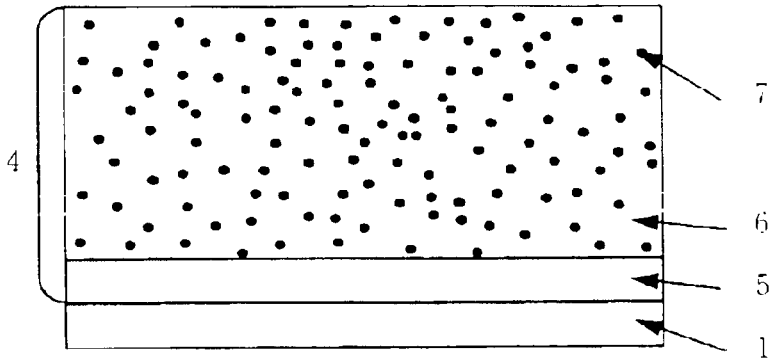
FIG. 7 is a sectional view illustrating a layer structure of a monolayer type electrophotographic photoreceptor, in which an undercoat layer is provided between a photosensitive layer and an electroconductive support.

In FIGS. 1 and 2, a photosensitive layer 4 is provided on an electroconductive support 1, and the photosensitive layer 4 comprises a laminated body of a charge generating layer 2 containing a charge generating material as the main component and a charge transporting layer 3 containing a charge transporting material and a polycarbonate resin as the main components. As illustrated in FIGS. 3 to 5, an undercoat layer 5 may be provided between the photosensitive layer 4 and the electroconductive support 1 in order to adjust a charge, and as illustrated in FIGS. 4 and 5, a protective layer 8 may be provided as an outermost layer. Also, in the present invention, as illustrated in FIGS. 6 and 7, a photosensitive layer 4 having a charge generating material 7 dissolved or dispersed in a charge transporting material-containing layer 6 directly or by way of an undercoat layer 5 on the electroconductive support 1.

The electrophotographic photoreceptor of the present invention can be prepared in accordance with a usual method in the following manner. For example, a coating solution is prepared by dissolving an indane compound expressed by the formula (1) and a polycarbonate resin expressed by the formula (4) in an appropriate solvent and optionally adding a charge generating material, an electron attractive compound, an antioxidant, a UV ray absorber, a photostabilizer, a plasticizer, a pigment or other additives. The coating solution thus prepared is coated on an electroconductive support and is dried to form a photosensitive layer having a thickness of from a few $\mu$m to several tens $\mu$m, thereby producing an electrophotographic photoreceptor. When a photosensitive layer comprises two layers of a charge generating layer and a charge transporting layer, the photosensitive layer can be prepared by coating a charge generating layer with a coating solution prepared by dissolving an indane compound of the formula (1) and a polycarbonate resin of the formula (4) in an appropriate solvent and adding an antioxidant, a UV ray absorber, a photostabilizer, a plasticizer, a pigment or other additives, or by forming a charge generating layer on a charge transporting layer obtained by coating the above coating solution. Also, if necessary, an undercoat layer or a protective layer may be provided on the photosensitive layer thus prepared.

In the electrophotographic photoreceptor of the present invention, a weight ratio of an indane compound: a polycarbonate resin is from 2:8 to 7:3, preferably from 3:7 to 6:4.

Also, the electrophotographic photoreceptor of the present invention can be produced in accordance with a usual method in the following manner. For example, a coating solution is prepared by dissolving an indane compound expressed by the formulae (1) to (3) and an additive expressed by the formulae (6) to (16), together with a binder resin, in an appropriate solvent, and optionally adding a charge generating material, an electron attractive compound, a plasticizer, a pigment or other additives. The electrophotographic photoreceptor is produced by coating the above prepared coating solution on an electroconductive support and drying to form a photosensitive layer having a thickness of from a few $\mu$m to several tens $\mu$m. When a photosensitive layer comprises two layers of a charge generating layer and a charge transporting layer, the photosensitive layer is prepared by coating a coating solution prepared by dissolving an indane compound expressed by the formulae (1) to (3) and an antioxidant expressed by the formula (6) to (16), together with a binder resin, in an appropriate solvent and adding a plasticizer, a pigment or other additives, on a charge generating layer, or forming a charge generating layer on a charge transporting layer obtained by coating the above coating solution. Also, if necessary, an undercoat layer or protective layer may be provided on the above prepared photosensitive layer.

Respective materials employed in the present invention are illustrated below. Examples of additives expressed by the formulae (6) to (16) are illustrated below, but should not be limited thereto.

TABLE 1-(1)

Organic phosphite compounds of the formula (6)

| No. | Structural formulae |
|---|---|
| I-(1) | $P(OCH_3)_3$ |
| I-(2) | $P(OC_2H_5)_3$ |
| I-(3) | $P(OC_4H_9)_3$ |
| I-(4) | $P(OC_4H_9)_3$ |
| I-(5) | $P(OC_{12}H_{25})_3$ |
| I-(6) | $P(OC_{18}H_{37})_3$ |
| I-(7) | 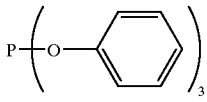 |
| I-(8) | 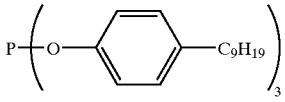 |
| I-(9) | 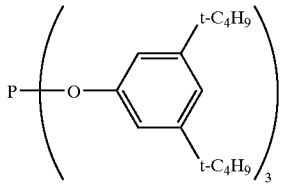 |
| I-(10) | 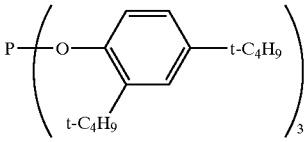 |
| I-(11) | 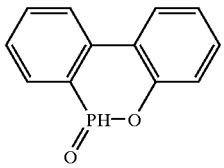 |

TABLE 1-(2)
| No. | Organic phosphite compounds of the formula (6) Structural formulae |
|---|---|
| I-(12) | 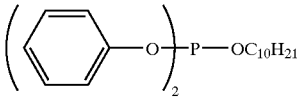 |
| I-(13) | 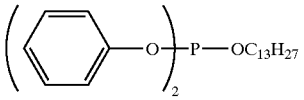 |
| I-(14) | 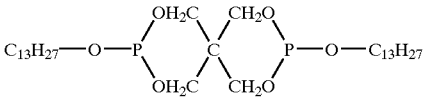 |
| I-(15) | 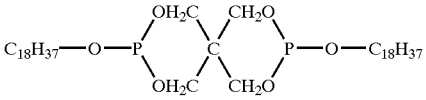 |
| I-(16) | 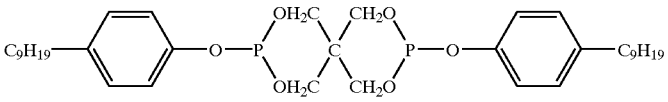 |
| I-(17) | 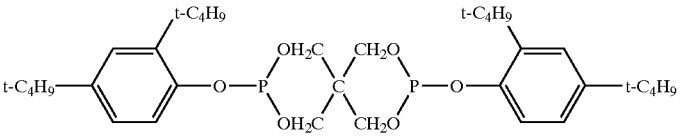 |
| I-(18) | 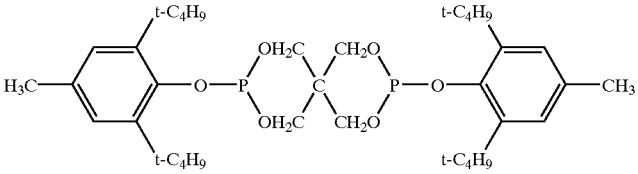 |
| I-(19) | 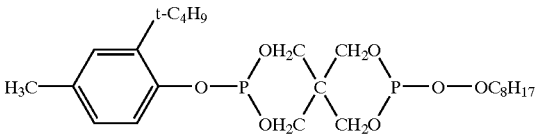 |
| I-(20) | 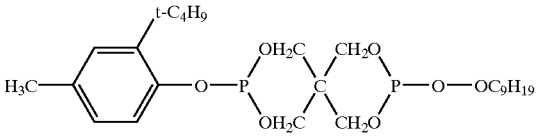 |
| I-(21) | 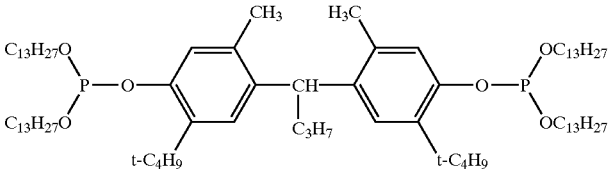 |

TABLE 1-(2)-continued

| Organic phosphite compounds of the formula (6) | |
|---|---|
| No. | Structural formulae |
| I-(22) | 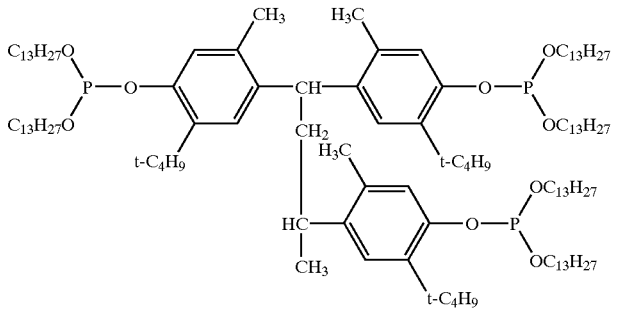 |

TABLE 2

| Triphenylated phosphorus compounds of the formula (7) | |
|---|---|
| No. | Structural formulae |
| II-(1) | 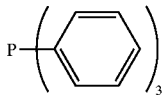 |
| II-(2) | 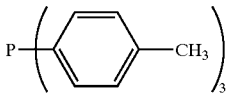 |
| II-(3) | 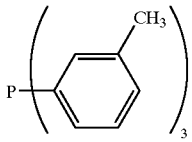 |
| II-(4) | 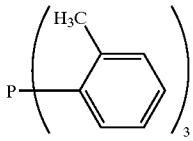 |
| II-(5) | 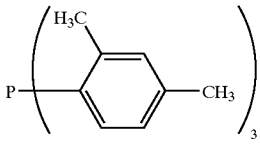 |
| II-(6) | 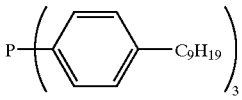 |
| II-(7) | 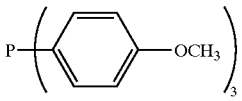 |

TABLE 2-continued

| Triphenylated phosphorus compounds of the formula (7) | |
|---|---|
| No. | Structural formulae |
| II-(8) | 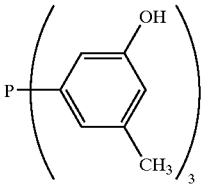 |

TABLE 3

| Thioether compounds of the formula (8) | |
|---|---|
| No. | Structural formulae |
| III-(1) | $S(C_8H_{17})_2$ |
| III-(2) | $S(C_{12}H_{25})_2$ |
| III-(3) | $S(C_{16}H_{33})_2$ |
| III-(4) | $S(CH_2CH_2COOH)_2$ |
| III-(5) | $S(CH_2CH_2COOC_8H_{17})_2$ |
| III-(6) | $S(CH_2CH_2COOC_{12}H_{25})_2$ |
| III-(7) | $S(CH_2CH_2COOC_{13}H_{27})_2$ |
| III-(8) | $S(CH_2CH_2COOC_{13}H_{27})_2$ |
| III-(9) | $S(CH_2CH_2COOC_{14}H_{29})_2$ |
| III-(10) | $S(CH_2CH_2COOC_{18}H_{37})_2$ |

TABLE 3-continued
| Thioether compounds of the formula (8) | |
|---|---|
| No. | Structural formulae |
| III-(11) | 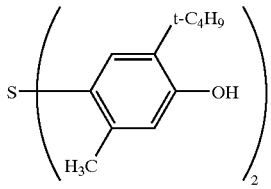 |
| III-(12) | 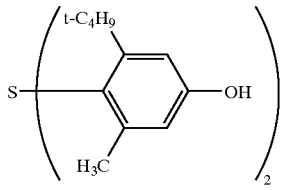 |
TABLE 4-(1)
| Hydroquinone compounds of the formula (9) | |
|---|---|
| No. | Structural formulae |
| IV-(1) | 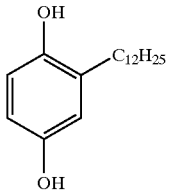 |
| IV-(2) | 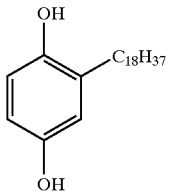 |
| IV-(3) | 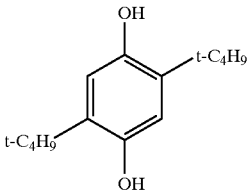 |
| IV-(4) | 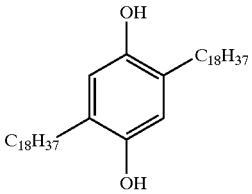 |
TABLE 4-(1)-continued
| Hydroquinone compounds of the formula (9) | |
|---|---|
| No. | Structural formulae |
| IV-(5) | 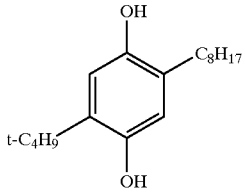 |
| IV-(6) | 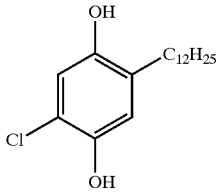 |
| IV-(7) | 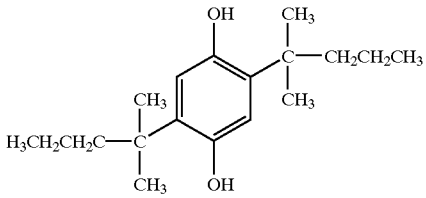 |
| IV-(8) | 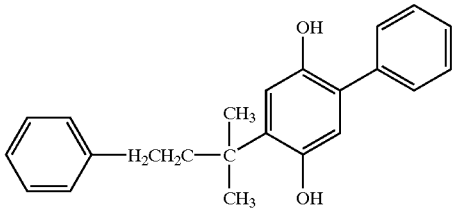 |
| IV-(9) | 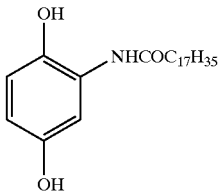 |
TABLE 4-(2)
| Hydroquinone compounds of the formula (9) | |
|---|---|
| No. | Structural formulae |
| IV-(10) | 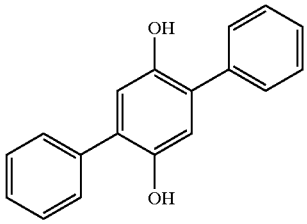 |

TABLE 4-(2)-continued
Hydroquinone compounds of the formula (9)
| No. | Structural formulae |
|---|---|
| IV-(11) | 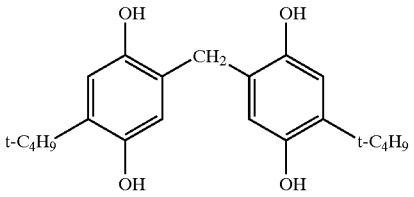 |
| IV-(12) | 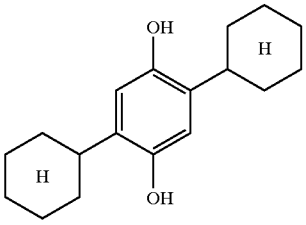 |
| IV-(13) | 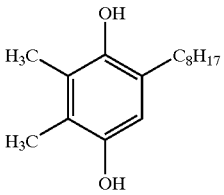 |
| IV-(14) | 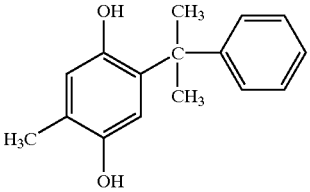 |
| IV-(15) | 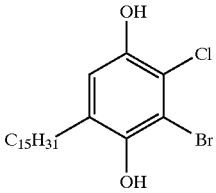 |
| IV-(16) | 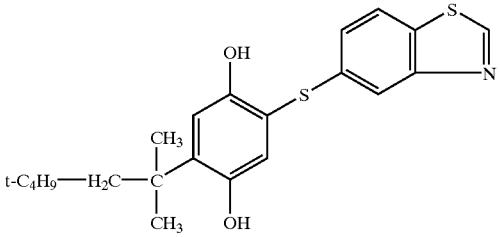 |
| IV-(17) | 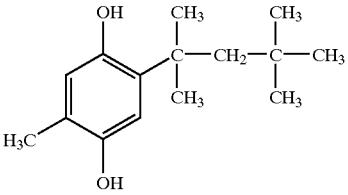 |
TABLE 4-(3)
Hydroquinone compounds of the formula (9)
| No. | Structural formulae |
|---|---|
| IV-(18) | 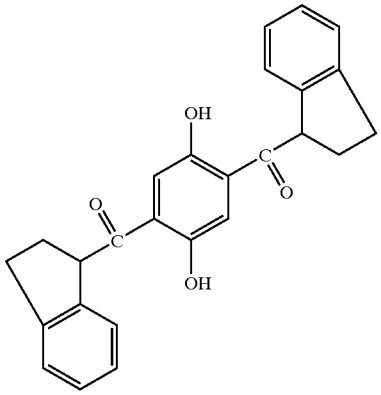 |
| IV-(19) | 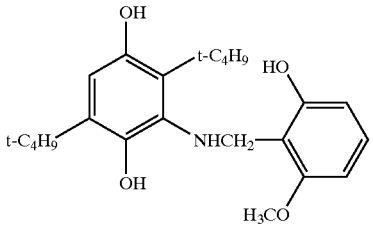 |
| IV-(20) | 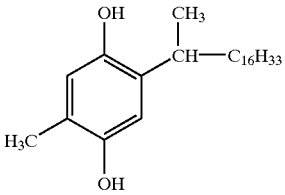 |
| IV-(21) | 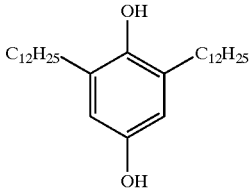 |
| IV-(22) | 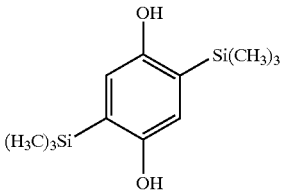 |
| IV-(23) | 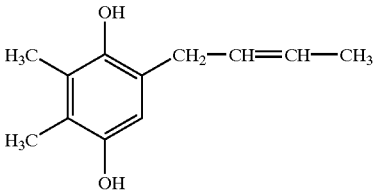 |

TABLE 4-(3)-continued
| Hydroquinone compounds of the formula (9) | |
|---|---|
| No. | Structural formulae |
| IV-(24) | 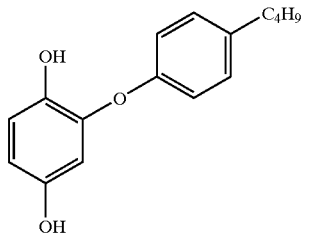 |
TABLE 4-(4)
| Hydroquinone compounds of the formula (9) | |
|---|---|
| No. | Structural formulae |
| IV-(25) | 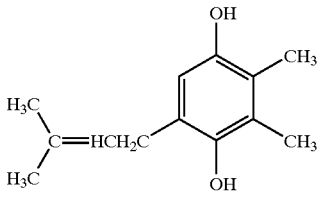 |
| IV-(26) | 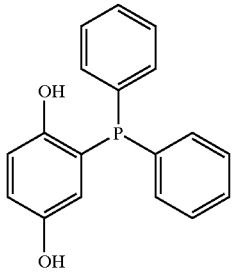 |
| IV-(27) | 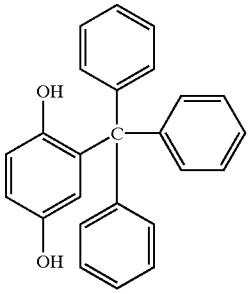 |
| IV-(28) | 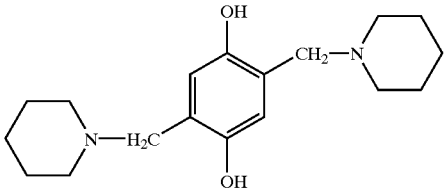 |
TABLE 4-(4)-continued
| Hydroquinone compounds of the formula (9) | |
|---|---|
| No. | Structural formulae |
| IV-(29) | 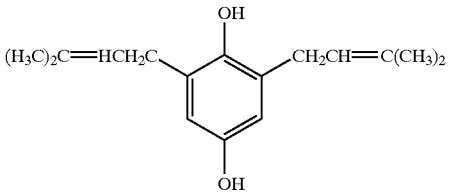 |
| IV-(30) | 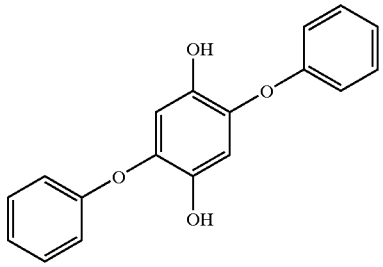 |
| IV-(31) | 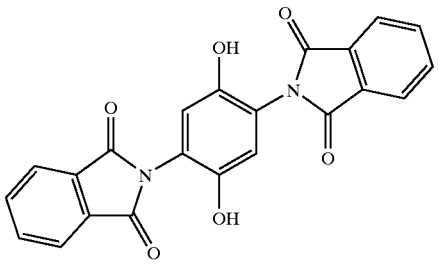 |
| IV-(32) | 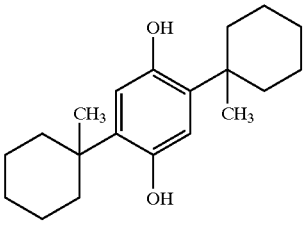 |
TABLE 5-(1)
| Benzotriazole compounds of the formula (10) | |
|---|---|
| No. | Structural formulae |
| V-(1) | 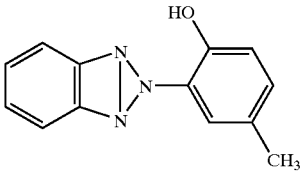 |

TABLE 5-(1)-continued
Benzotriazole compounds of the formula (10)
| No. | Structural formulae |
|---|---|
| V-(2) | 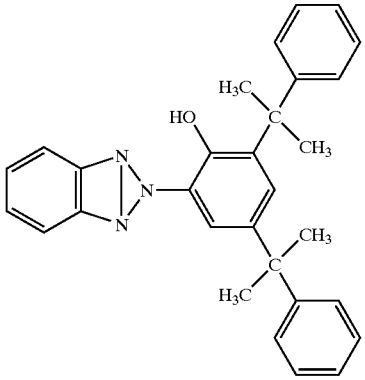 |
| V-(3) | 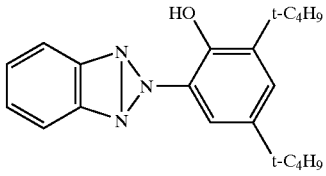 |
| V-(4) | 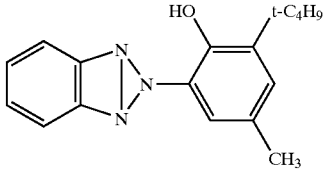 |
| V-(5) | 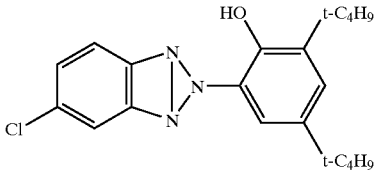 |
| V-(6) | 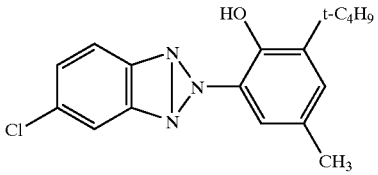 |
| V-(7) | 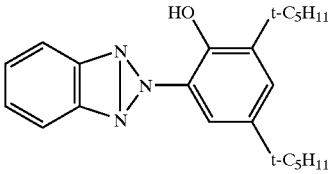 |
| V-(8) | 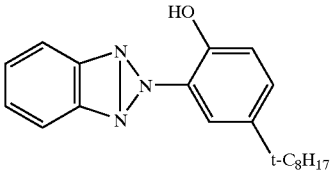 |
TABLE 5-(2)
Benzotriazole compounds of the formula (10)
| No. | Structural formulae |
|---|---|
| V-(9) | 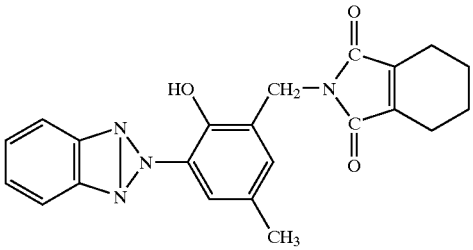 |
| V-(10) | 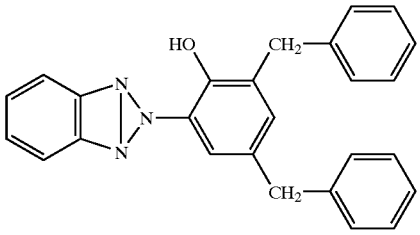 |
| V-(11) | 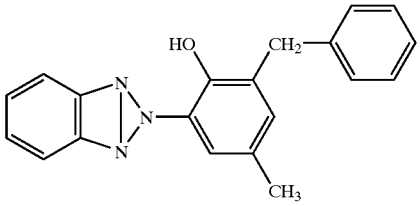 |
| V-(12) | 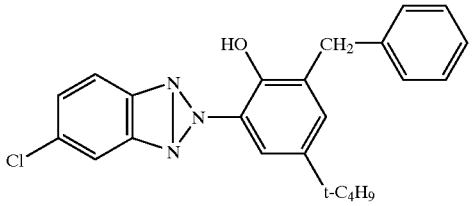 |
TABLE 6-(1)
Benzotriazole-alkylenebisphenol compounds of the formula (11)
| No. | Structural formulae |
|---|---|
| VI-(1) | 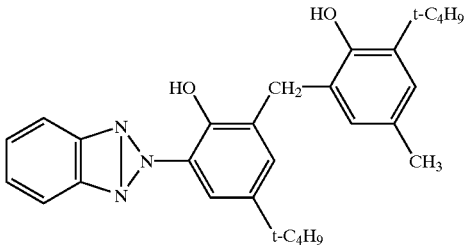 |

TABLE 6-(1)-continued
Benzotriazole-alkylenebisphenol compounds of the formula (11)
| No. | Structural formulae |
|---|---|
| VI-(2) | 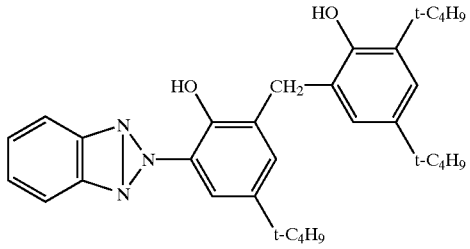 |
| VI-(3) | 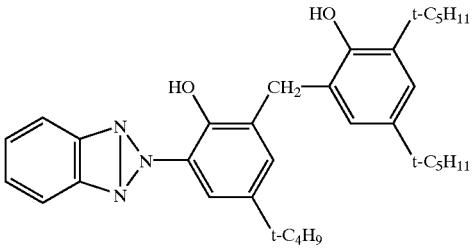 |
| VI-(4) | 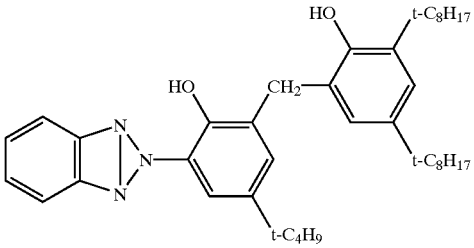 |
| VI-(5) | 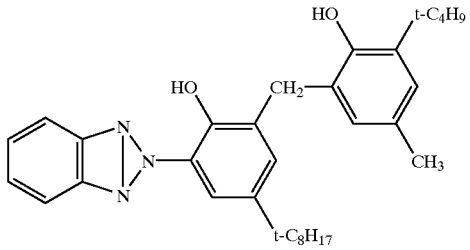 |
| VI-(6) | 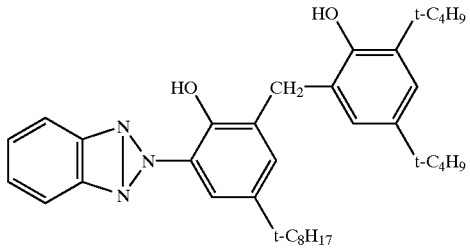 |
| VI-(7) | 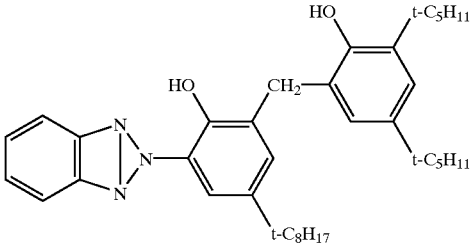 |
TABLE 6-(1)-continued
Benzotriazole-alkylenebisphenol compounds of the formula (11)
| No. | Structural formulae |
|---|---|
| VI-(8) | 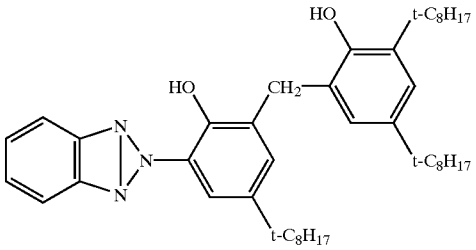 |
TABLE 6-(2)
Benzotriazole-alkylenebisphenol compounds of the formula (11)
| No. | Structural formulae |
|---|---|
| VI-(9) | 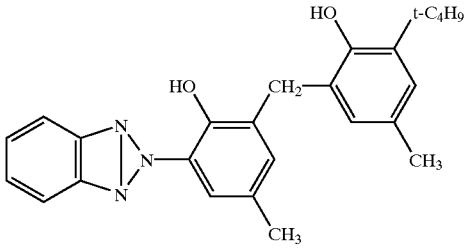 |
| VI-(10) | 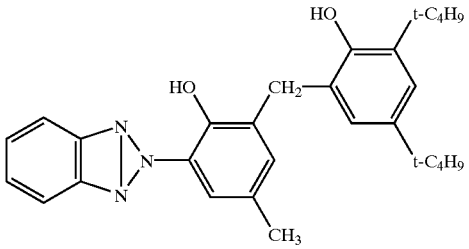 |
| VI-(11) | 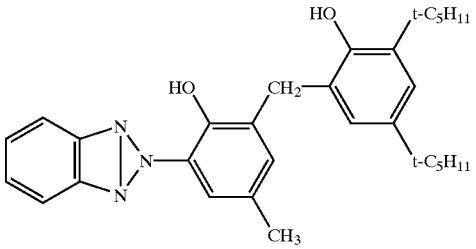 |
| VI-(12) | 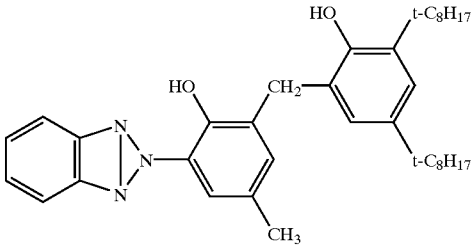 |

TABLE 7
| No. | Hydroxybenzophenone compounds of the formula (12) Structural formulae |
|---|---|
| VII-(1) | 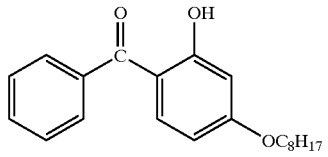 |
| VII-(2) | 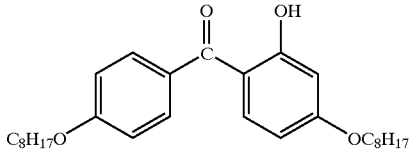 |
| | 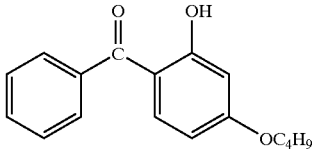 |
| VII-(4) | 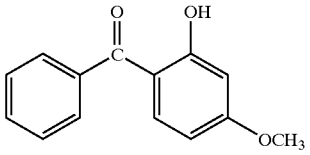 |
| VII-(5) | 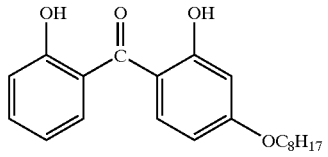 |
| VII-(6) | 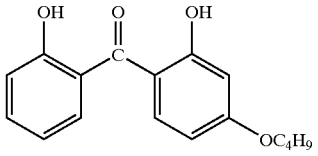 |
| VII-(7) | 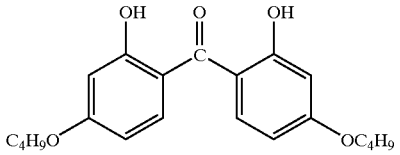 |
| VII-(8) | 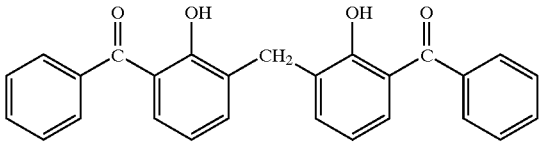 |
| VII-(9) | 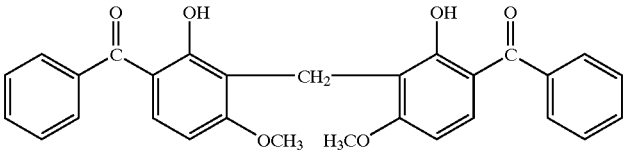 |

TABLE 8-(1)
| Hydroxybenzophenone compounds of the formulae (13) and (14) | |
|---|---|
| No. | Structural formulae |
| VIII-(1) | 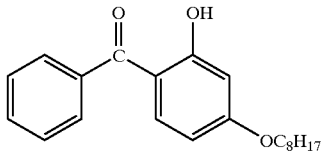 |
| VIII-(2) | 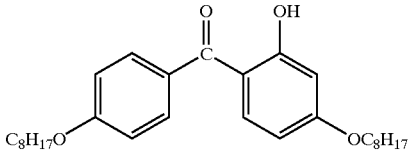 |
| VIII-(3) | 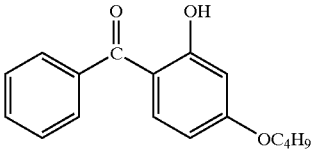 |
| VIII-(4) | 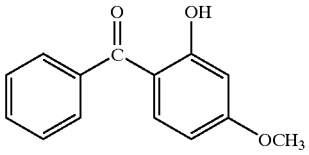 |
| VIII-(5) | 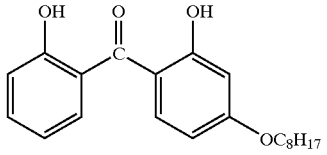 |
| VIII-(6) | 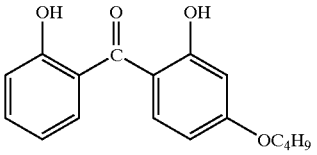 |
| VIII-(7) | 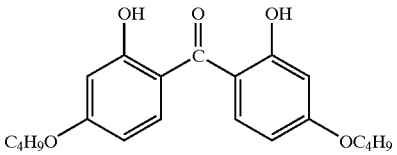 |
| VIII-(8) | 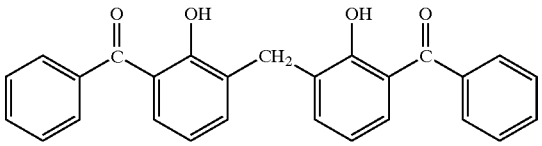 |
| VIII-(9) | |

TABLE 8-(1)-continued
| Hydroxybenzophenone compounds of the formulae (13) and (14) | |
|---|---|
| No. | Structural formulae |
| VIII-(10) | 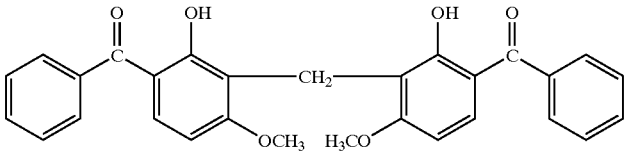 |
TABLE 8-(2)
| Hydroxybenzophenone compounds of the formulae (13) and (14) | |
|---|---|
| No. | Structural formulae |
| VIII-(11) | 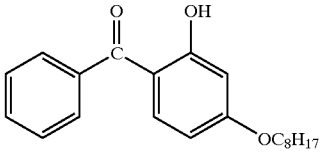 |
| VIII-(12) | 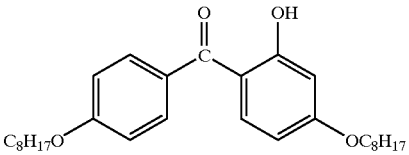 |
| VIII-(13) | 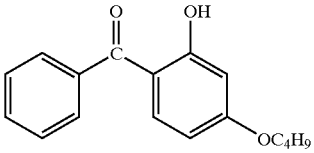 |
| VIII-(14) | 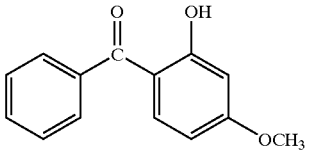 |
| VIII-(15) | 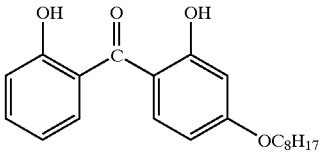 |
| VIII-(16) | 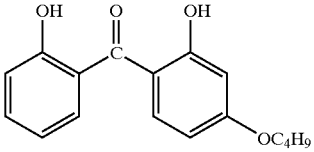 |
| VIII-(17) | 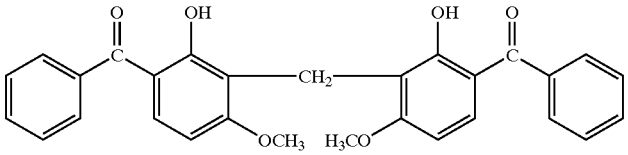 |

TABLE 8-(3)
Hydroxybenzophenone compounds of the formulae (13) and (14)
| No. | Structural formulae |
|---|---|
| VIII-(18) | 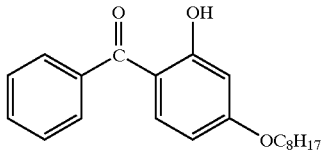 |
| VIII-(19) | 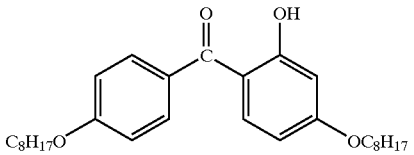 |
| VIII-(20) | 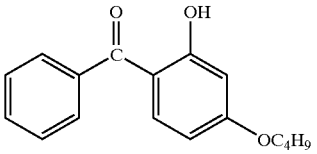 |
| VIII-(21) | 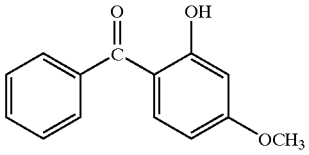 |
| VIII-(22) | 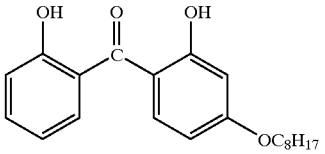 |
| VIII-(23) | 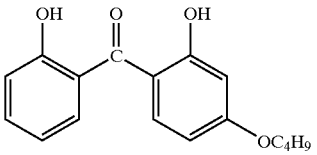 |
| VIII-(24) | 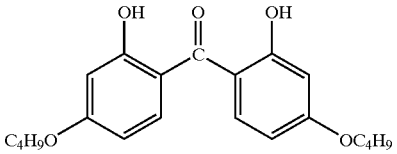 |
| VIII-(25) | 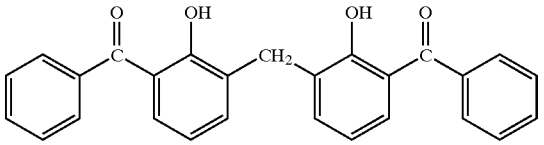 |
| VIII-(26) | 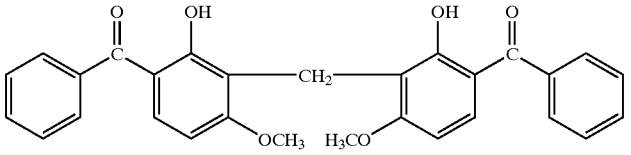 |

TABLE 8-(4)
| Hydroxybenzophenone compounds of the formulae (13) and (14) | |
|---|---|
| No. | Structural formulae |
| VIII-(27) | 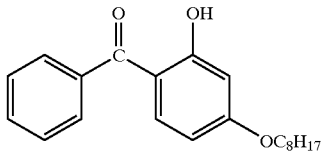 |
| VIII-(28) | 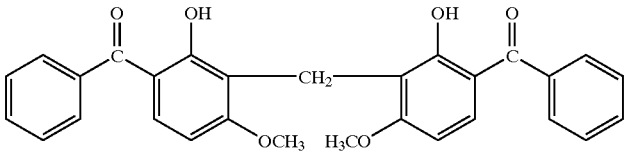 |
TABLE 9-(1)
| Hindered amine compounds of the formula (15) | |
|---|---|
| No. | Structural formulae |
| IX-(1) | 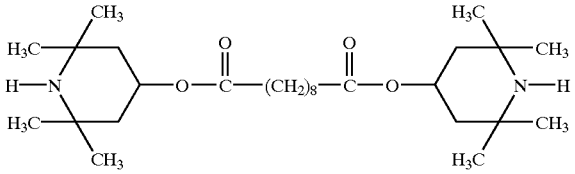 |
| IX-(2) | 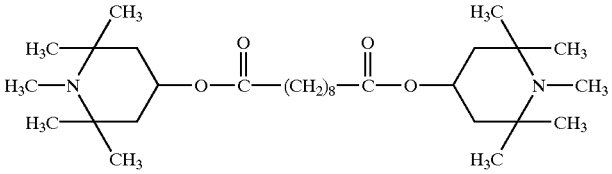 |
| IX-(3) | 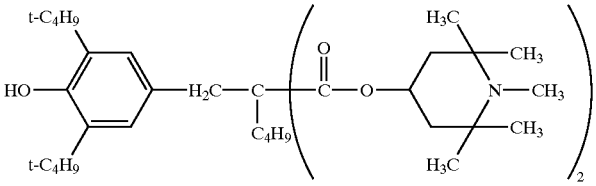 |
| IX-(4) | 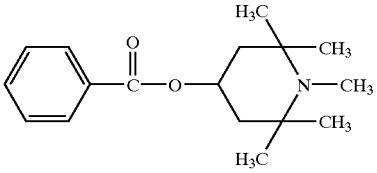 |
| IX-(5) | 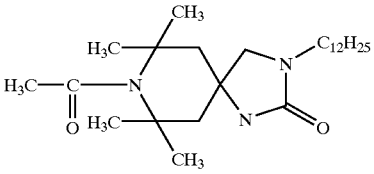 |

TABLE 9-(1)-continued
| No. | Hindered amine compounds of the formula (15) Structural formulae |
|---|---|
| IX-(6) | 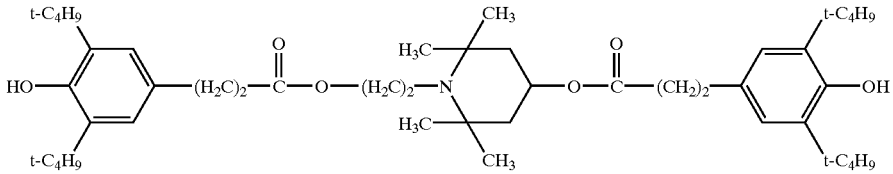 |
| IX-(7) | 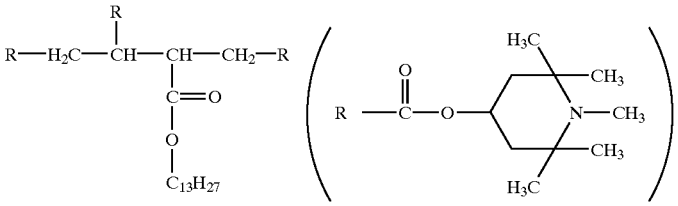 |
| IX-(8) | 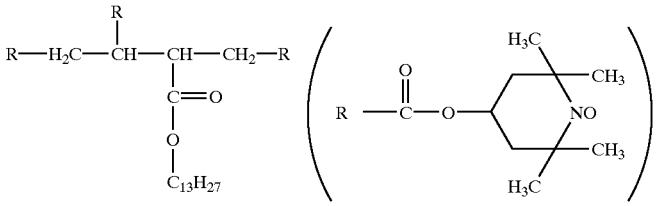 |
TABLE 9-(2)
| No. | Hindered amine compounds of the formula (15) Structural formulae |
|---|---|
| IX-(9) | 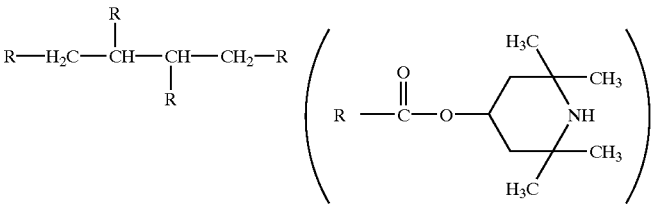 |
| IX-(10) | 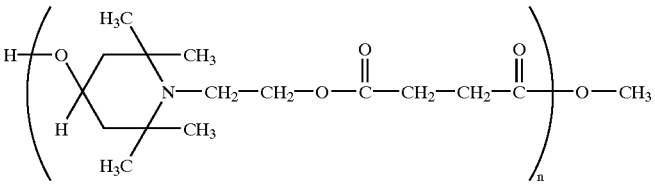 |

TABLE 10

Salicylate compounds of the formula (16)

| No. | Structural formulae |
|---|---|
| IV-(1) | 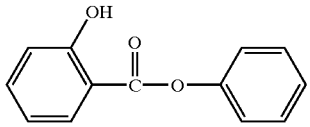 |
| IV-(2) | 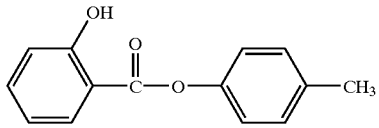 |
| IV-(3) | 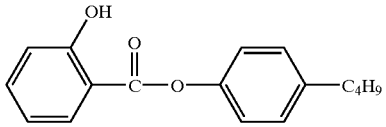 |
| IV-(4) | 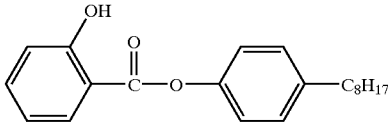 |
| IV-(5) | 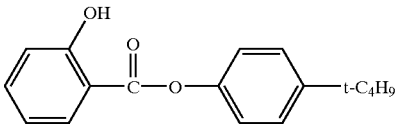 |
| IV-(6) | 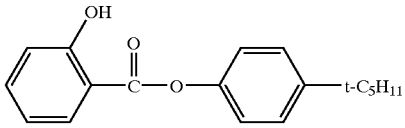 |

In the electrophotographic photoreceptor of the present invention, an amount of the above additive is from 0.05 to 30 wt %, preferably from 0.1 to 20 wt %, to an indane compound of the formulae (1) to (3).

In the present invention, the electroconductive support, on which a photosensitive layer is formed, may be a material commonly used in a well known electrophotographic photoreceptor. Examples of the electroconductive support include a metal drum or sheet of aluminum, an aluminum alloy, a stainless steel, copper, zinc, vanadium, molybdenum, chromium, titanium, nickel, indium, gold or platinum, or their metal laminates, vapor-deposited materials or metal powders, carbon black, copper iodide, a plastic film, plastic drum, paper or paper tube, which is coated with a high molecular electrolyte electroconductive material together with an appropriate binder for electroconductive treatment, or a plastic film or plastic drum, to which electroconductivity is imparted by containing an electroconductive material.

Also, if necessary, an undercoat layer containing a resin or a mixture of a resin and a pigment may be provided between an electroconductive support and a photosensitive layer. The pigment dispersed in the undercoat layer may be generally usable powders, but it is preferable to employ a powder having a white color or a similar color, which does not substantially have an absorption in near-infrared rays, in view of high sensitivity. Examples of these pigments include metal oxides as illustrated typically by titanium oxide, zinc oxide, tin oxide, indium oxide, zirconium oxide, alumina or silica, and it is preferable to employ a pigment which does not absorb a moisture and is environmentally stable.

Also, the resin used for the undercoat layer is preferably a resin having a high solvent resistance to a general organic solvent when considering that a photosensitive layer is coated with a solvent thereon. Examples of such a resin include a water-soluble resin such as polyvinyl alcohol, casein or sodium polyacrylate, an alcohol-soluble resin such as copolymerized nylon or methoxymethylated nylon, a curable resin forming a tri-dimensional network structure such as polyurethane, melamine resin or epoxy resin, and the like.

In the present invention, a charge generating layer comprises a charge generating agent, a binder resin and optionally an additive, and is prepared for example by a coating method, a vapor-depositing method, a CVD method or the like.

Examples of the charge generating agent include various crystalline titanyl phthalocyanines, a titanyl phthalocyanine having intensive peaks at diffraction angles $2\theta\pm0.2°$ of 9.3, 10.6, 13.2, 15.1, 20.8, 23.3 and 26.3 in X-ray diffraction spectrum of Cu—K$\alpha$, a titanyl phthalocyanine having intensive peaks at diffraction angles $2\theta\pm0.2°$ of 7.5, 10.3, 12.6, 22.5, 24.3, 25.4 and 28.6, a titanyl phthalocyanine having intensive peaks at diffraction angles $2\theta\pm0.2°$ of 9.6, 24.1 and 27.2, various crystalline metal free phthalocyanines of $\tau$ type or X type, copper phthalocyanine, aluminum phthalocyanine, zinc phthalocyanine, $\alpha$ type, $\beta$ type or Y type oxotitanyl phthalocyanine, cobalt phthalocyanine, hydroxygallium phthalocyanine, chloroaluminum phthalocyanine, chloroindium phthalocyanine, and other phthalocyanine type pigments, azo type pigments such as an azo pigment having a triphenylamine structure (as described in JP-A-53-132347), an azo pigment having a carbazole structure (as described in JP-A-53-95033), an azo pigment having a fluorene structure (as described in JP-A-54-22834), an azo pigment having an oxadiazole structure (as described in JP-A-54-12742), an azo pigment having a bisstilbene structure (as described in JP-A-54-17733), an azo pigment having a dibenzothiophene structure (as described in JP-A-54-21728), an azo pigment having a distyrylbenzene structure (as described in JP-A-53-133445), an azo pigment having a distyrylcarbazole structure (as described in JP-A-54-17734), an azo pigment having a distyryloxadiazole structure (as described in JP-A-54-2129), an azo pigment having a stilbene structure (as described in JP-A-53-138229), a trisazo pigment having a carbazole structure (as described in JP-A-57-195767 and JP-A-57-195768), an azo pigment having an anthraquinone structure (as described in JP-A-57-202545), a bisazo pigment having a diphenylpolyene structure (as described in JP-A-59-129857, JP-A-62-267363, JP-A-64-79753, JP-B-3-34503 and JP-B-4-52459) or the like, perylene pigments such perylenic acid anhydride or perylenic acid imide, polycyclic quinone pigments such as an anthraquinone derivative, an ansanthrone derivative, a dibenzpyrenequinone derivative, a pyranthrone derivative, a bioranthorone derivative and an isobioranthorone derivative, diphenylmethane and triphenylmethane type pigments, cyanine and azomethine type pigments, indigoid type pigments, bisbenzoimidazole type pigments, azulenium salt, pyrylium salt, thiapyrylium salt, benzopyrylium salt, squarilium salt, and the like. These pigments may be used alone or in a mixture of two or more, if necessary.

Examples of a binder resin used in a charge generating layer are not specially limited, examples of which include polycarbonate, polyarylate, polyester, polyamide, polyethylene, polystyrene, polyacrylate, polymethacrylate, polyvinyl butyral, polyvinyl acetal, polyvinyl formal, polyvinyl alcohol, polyacrylonitrile, polyacrylamide, styrene-acryl copolymer, styrene-maleic anhydride copolymer, acrylonitrile-butadiene copolymer, polysulfone, polyether sulfone, silicone resin, phenoxy resin, and the like. They may be used alone or in a mixture of two or more, if necessary.

Examples of additives used as required, include an antioxidant, a UV ray absorber, a dispersant, an adhesive, a sensitizier and the like. A layer thickness of a charge generating layer prepared by using the above-mentioned materials is from 0.1 to 2.0 μm, preferably from 0.1 to 1.0 μm.

In the present invention, a charge transporting layer can be formed by dissolving a charge transporting agent, a binder resin and optionally an electron-acceptive material and an additive in a solvent, coating the solution on a charge generating layer, an electroconductive support or an undercoat layer, and drying the coated material.

Examples of a binder resin for a charge transporting layer include a vinyl compound polymer or copolymer such as styrene, vinyl acetate, vinyl chloride, acrylic acid ester or methacrylic acid ester butadiene, polyvinyl acetal or polycarbonate (as described in JP-A-60-172044, JP-A-62-247374, JP-A-63-148263 or JP-A-2-254459), polyester, polyphenylene oxide, polyurethane cellulose ester, phenoxy resin, silicone resin, epoxy resin and other various resins having a compatibility with a charge transporting agent and an additive. They may be used alone or in a mixture of two or more, if necessary. Also, an amount of a binder resin used, is usually in a range of from 0.4 to 10 times weight, preferably from 0.5 to 5 times weight to a charge transporting agent. Examples of a particularly effective resin include a polycarbonate type resin such as "Iupilon Z" (manufactured by Mitsubishi Engineering-Plastic Corporation) or "Bisphenol A-bisphenol copolycarbonate" (manufactured by Idemitsu Kosan K. K.).

Examples of a solvent used for a charge transporting layer, are not specially limited as far as it dissolves a charge transporting agent, a binder resin, an electron-acceptive material and an additive, typical examples of which include a polar organic solvent such as tetrahydrofuran, 1,4-dioxane, methyl ethyl ketone, cyclohexanone, acetonitrile, N,N-dimethylformamide or ethyl acetate, an aromatic organic solvent such as toluene, xylene or chlorobenzene, a chlorine type hydrocarbon solvent such as chloroform, trichloroethylene, dichloromethane, 1,2-dichloroethane or carbon tetrachloride, and the like. They may be used alone or in a mixture of two or more, if necessary.

Also, in the present invention, in order to improve a sensitivity of a photosensitive layer, to reduce a residual potential or to reduce a fatigue at the time of repeatedly using, an electron-acceptive material may be contained. Examples of the electron-acceptive material include succinic anhydride, maleic anhydride, dibromosuccinic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picryl chloride, quinonechloroimide, chloranyl, bromanyl, dichlorodicyano-p-benzoquinone, anthraquinone, dinitroanthraquinone, 2,3-dichloro-1,4-naphthoquinone, 1-nitroanthraquinone, 2-chloroanthraquinone, phenanthrenequinone, terephthalylmalenonitrile, 9-anthrylmethylidene malenonitrile, 9-fluorenilidene malononitrile, polynitro-9-fluorenilidene malononitrile, 4-nitrobenzaldehyde, 9-benzoylanthracene, indanedione, 3,5-dinitrobenzophenone, 4-chloronaphthalic anhydride, 3-benzalphthalide, 3-(α-cyano-p-nitrobenzal)-4,5,6,7-tetrachlorophthalide, picric acid, o-nitrobenzoic acid, p-nitrobenzoic acid, 3,5-dinitrobenzoic acid, pentafluorobenzoic acid, 5-nitrosalicylic acid, 3,5-dinitrosalicyclic acid, phthalic acid, mellitic acid and other compounds having an electron affinity.

Further, additives used as required, include an antioxidant, a UV ray absorber, a plasticizer, a quencher, a dispersant, a lubricant, and the like. Examples of the antioxidant include a monophenol type compound such as 2,6-di-tert-butyl-p-cresol, 2,6-di-tert-butyl-4-methoxyphenol, 2-tert-butyl-4-methoxyphenol, 2,4-dimethyl-6-tert-butylphenol, 2,6-di-tert-butyl-4-methylphenol, butyrated hydroxyanisol, stearyl-β-(3,5-di-tert-butyl-4-hydroxyphenyl propionate, α-tocopherol, β-tocopherol, 2,4-bis-(n-octylthio)-6-(4-hydroxy-3,5-di-tert-butylanilino)-1,3,5-triazine, octadecyl-3-(3,5-di-tert-butyl-4-hydroxyphenyl)propionate, 3,5-di-tert-butyl-4-hydroxy-benzylphosphonate-diethyl ester, 2,4-bis[(octylthio)methyl]-o-cresol, isooctyl-3-(3,5-di-tert-butyl-4-hydroxyphenyl)propionate or the like, and a polyphenol type compound such as triethylene glycol-bis[3-(3-tert-butyl-5-methyl-4-hydroxyphenyl)propionate], 1,6-hexanediol-bis[3-(3,5-di-tert-butyl-4-hydroxyphenyl)propionate], pentaerythrityl-tetrakis[3-(3,5-di-tert-butyl-4-hydroxyphenyl)propionate], 2,2-thio-diethylenebis[3-(3,5-di-tert-butyl-4-hydroxyphenyl)propionate], N,N'-hexamethylenebis(3,5-di-tert-butyl-4-hydroxy-hydroxycinnamide), 1,3,5-trimethyl-2,4,6-tris(3,5-di-tert-butyl-4-hydroxybenzyl)benzene, tris-(3,5-di-tert-butyl-4-hydroxybenzyl)-isocyanurate, 2,2-thiobis(4-methyl-6-tert-butylphenol), 2,2'-methylenebis(6-tert-butyl-4-methylphenol), 4,4'-butylidene-bis-(3-methyl-6-tert-butylphenol), 4,4'-thiobis(6-tert-butyl-3-methylphenol), 1,1,3-tris(2-methyl-4-hydroxy-5-tert-butylphenyl)butane, or the like. These monophenol compounds and polyphenol compounds may be used alone or in a mixture of two or more. Further, they may be used in a mixture with a UV ray absorber and a photostabilizer.

Examples of a UV ray absorber include a benzotriazole type compound such as 2-(5-methyl-2-hydroxyphenyl) benzotriazole, 2-[2-hydroxy-3,5-bis(α,α-dimethylbenzyl) phenyl]-benzotriazole, 2-(3,5-di-tert-butyl-2-hydroxyphenyl)benzotriazole, 2-(3-tert-butyl-5-methyl-2-hydroxyphenyl)-5-chlorobenzotriazole, 2-(3,5-di-tert-butyl-2-hydroxyphenyl)-5-chlorobenzotriazole, 2-(3,5-di-tert-amyl-2-hydroxyphenyl)benzotriazole, 2-(2-hydroxy-5-tert-octylphenyl)benzotriazole, 2-[2-hydroxy-3-(3,4,5,6-tetrahydrophthalimide-methyl)-5-methylphenyl] or the like, a benzophenone type compound such as 2-hydroxy-4-methylbenzophenone, 2-hydroxy-4-n-octoxybenzophenone, 2,2',4,4'-tetrahydroxybenzophenone, 2,4-dihydroxybenzophenone, 2,2'-dihydroxy-4,4'-dimethoxybenzophenone, 2,2'-dihydroxy-4-methoxybenzophenone, 2-hydroxy-4-octadecyloxybenzophenone, 4-dodecyloxy-2-hydroxybenzophenone or the like, and a benzoate type compound, a cyanoacrylate type compound, an oxalic acid anilide type compound, a triazine type compound, and other commercially available materials. These UV ray absorbers may be used alone or in a mixture of two or more. Also, they may be used in a mixture with a photostabilizer and an antioxidant.

Examples of a photostabilizer include dimethyl succinate.1-(2-hydroxyethyl)-4-hydroxy-2,2,6,6-tetramethylpiperidine polycondensate, poly{[6-(1,1,3,3-tetramethylbutyl)amino-1,3,5-triazin-2,4-diyl][(2,2,6,6-tetramethyl-4-piperidyl)imino]hexamethylene[(2,2,6,6-tetramethyl-4-piperidyl)imino]}, N,N'-bis(3-aminopropyl) ethylenediamine.2,4-bis[N-butyl-N-(1,2,2,6,6-pentamethyl-4-piperidyl)amino]-6-chloro-1,3,5-triazine condensate, bis (2,2,6,6-tetramethyl-4-piperidyl) sebacate, bis(1,2,2,6,6-pentamethyl-4-piperidinyl) sebacate, bis(1,2,2,6,6-pentamethyl-4-piperizyl) 2-(3,5-di-tert-butyl-4-hydroxybenzyl)-2-n-butylmalonate, and other hindered amine compounds. These photostabilizers may be used alone or in a mixture of two or more. Also, they may be used in a mixture with a UV ray absorber and an antioxidant.

Also, as an additive, a compound having both functions as an antioxidant and a UV ray absorber in one molecule may be used, examples of which include 6-(2-benzotriazolyl)-4-tert-butyl-6'-tert-butyl-4'-methyl-2,2'-methylenebisphenol, 6-(2-benzotriazolyl)-4-tert-butyl-4',6'-di-tert-butyl-2,2'-methylenebisphenol, 6-(2-benzotriazolyl)-4-tert-butyl-4',6'-di-tert-amyl-2,2'-methylenebisphenol, 6-(2-benzotriazolyl)-4-tert-butyl-4',6'-di-tert-octyl-2,2'-methylenebisphenol, 6-(2-benzotriazolyl)-4-tert-octyl-6'-tert-butyl-4'-methyl-2,2'-methylenebisphenol, 6-(2-benzotriazolyl)-4-tert-octyl-4',6'-di-tert-butyl-2,2'-methylenebisphenol, 6-(2-benzotriazolyl)-4-tert-octyl-4',6'-di-tert-amyl-2,2'-methylenebisphenol, 6-(2-benzotriazolyl)-4-tert-octyl-4',6'-di-tert-octyl-2,2'-methylenebisphenol, 6-(2-benzotriazolyl)-4-methyl-6'-tert-butyl-4'-methyl-2,2'-methylenebisphenol, 6-(2-benzotriazolyl)-4-methyl-4',6'-di-tert-butyl-2,2'-methylenebisphenol, 6-(2-benzotriazolyl)-4-methyl-4',6'-di-tert-amyl-2,2'-methylenebisphenol, 6-(2-benzotriazolyl)-4-methyl-4',6'-di-tert-octyl-2,2'-methylenebisphenol, and other benzotriazole-alkylenebisphenol type compounds. These compounds may be used alone or in a mixture of two or more. Also, they may be used in a mixture with a UV ray absorber and an antioxidant.

Also, in the present invention, a photosensitive layer may further contain a well known plasticizer in order to improve a film-formability, a flexibility and a mechanical strength. Examples of the plasticizer include phthalic acid ester, phosphoric acid ester, chlorinated paraffin, methyl naphthalene, epoxy compound, chlorinated aliphatic acid ester, and the like.

The surface of the photosensitive material may be provided with a surface-protective layer as required. Examples of the materials used as the surface-protective layer include a resin such as polyester or polyamide, or a mixture of these resins with a metal or a metal oxide capable of adjusting an electric resistance. It is preferable that the surface-protective layer is as transparent as possible in a light-absorbing wavelength zone of a charge-generating agent.

EXAMPLES

Hereinafter, the present invention is further illustrated with reference to the Examples, but should not be limited thereto. In the Examples, a part is expressed by a part by weight, and a concentration is expressed by %.

Example 1

1 Part by weight of an alcohol-soluble polyamide (Amilan CM-4000, manufactured by Toray Industries, Inc.) was dissolved in 13 parts by weight of methanol. 5 Parts by weight of titanium oxide (Tipaque CR-EL, manufactured by Ishihara Sangyo Kaisha, Ltd.) was added thereto, and the mixture was dispersed by a paint shaker for 8 hours to prepare a coating solution for an undercoat layer, and the coating solution thus prepared was coated on an aluminum surface of an aluminum-vapor deposited PET film by a wire bar and was dried to form an undercoat layer having a thickness of 1 $\mu$m.

Thereafter, 1.5 parts of titanyl phthalocyanine (charge-generating agent No. 1) having intensive peaks at diffraction angles (2θ±0.2°) of 9.6, 24.1 and 27.2 in Cu—Kα X-ray diffraction spectrum

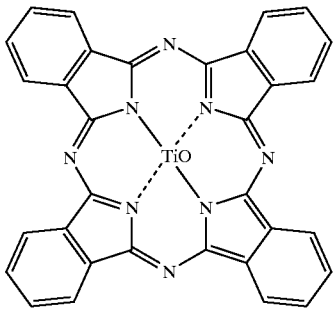

was added to 50 parts of a 3% cyclohexanone solution of polyvinyl butyral resin (Eslex BL-S, manufactured by Sekisui Chemical Co., Ltd.), and the mixture was dispersed by an ultrasonic dispersing machine for 1 hour. The dispersion thus obtained was coated on the above undercoat layer by a wire bar, and was dried at 110° C. under normal pressure for 1 hour to form a charge-generating layer having a film thickness of 0.6 $\mu$m.

On the other hand, 100 parts of the following indane compound (charge-transporting agent No. 1) as a charge-transporting agent

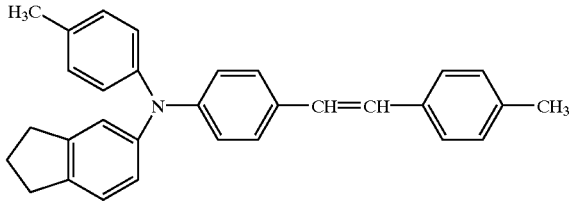

was added to 962 parts of a 13.0% tetrahydrofuran solution of the following polycarbonate resin (polycarbonate resin No. 1)

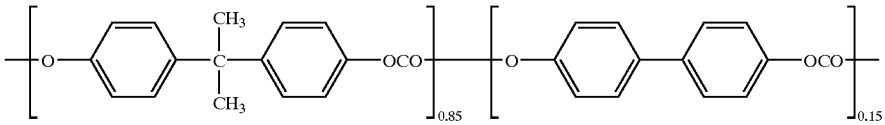

to have the indane compound completely dissolved by ultrasonic wave. The solution thus obtained was coated on the above charge-generating layer by a wire bar, and was dried at 110° C. under normal pressure for 30 minutes to form a charge-transporting layer having a film thickness of 20 μm, thus producing a photoreceptor.

Example 2

A photoreceptor was produced in the same manner as in Example 1, except that the following polycarbonate resin (polycarbonate resin No. 2) was used in place of polycarbonate resin No. 1 used in Example 1.

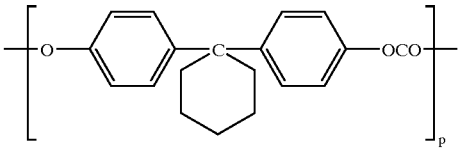

Example 3

A photoreceptor was produced in the same manner as in Example 1, except that titanylphthalocyanine (charge-generating agent No. 2) having intensive peaks at diffraction angles (2θ±0.2°) of 7.5, 10.3, 12.6, 22.5, 24.3, 25.4 and 28.6 in Cu—Kα X-ray diffraction spectrum was used in place of charge-generating agent No. 1 and the following indane compound (charge-transporting agent No. 2) was used in place of charge-transporting agent No. 1.

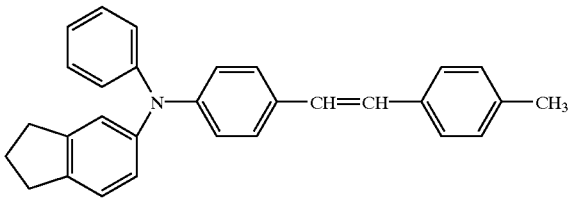

Example 4

A photoreceptor was produced in the same manner as in Example 3, except that polycarbonate No. 2 was used in place of polycarbonate No. 1 used in Example 3.

Example 5

A photoreceptor was produced in the same manner as in Example 1, except that titanylphthalocyanine (charge-generating agent No. 3) having intensive peaks at diffraction angles (2θ±0.2°) of 9.3, 10.6, 13.2, 15.1, 20.8, 23.3 and 26.3 in Cu—Kα X-ray diffraction spectrum was used in place of charge-generating agent No. 1 and the following indane compound (charge-transporting agent No. 3) was used in place of charge-transporting agent No. 1.

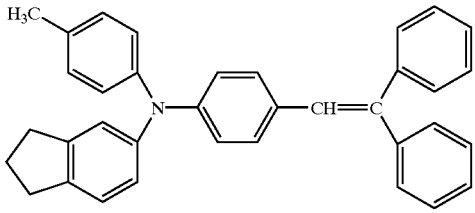

Example 6

A photoreceptor was produced in the same manner as in Example 5, except that polycarbonate resin No. 2 was used in place of polycarbonate resin No. 1 used in Example 5.

Example 7

A photoreceptor was produced in the same manner as in Example 5, except that the following indane compound (charge-transporting agent No. 4) was used in place of charge-transporting agent No. 3 used in Example 5.

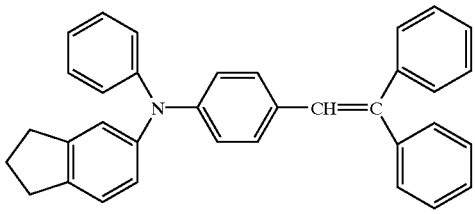

Example 8

A photoreceptor was produced in the same manner as in Example 7, except that polycarbonate resin No. 2 was used in place of polycarbonate resin No. 1 used in Example 7.

Example 9

10 Parts by weight of an alcohol-soluble polyamide (Amilan CM-8000, manufactured by Toray Industries, Inc.) was dissolved in 190 parts by weight of methanol, and the solution was coated on an aluminum surface of an aluminum-vapor deposited PET film by a wire bar and was dried to form an undercoat layer having a thickness of 1 μm. Thereafter, 1.5 parts of the following τ type metal free phthalocyanine (charge-generating agent No. 4) as a charge-generating agent

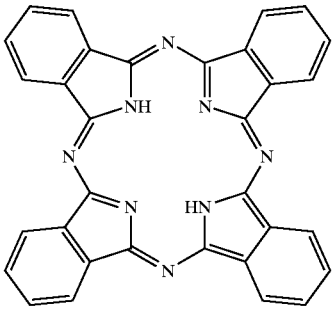

was added to 50 parts of a 3% cyclohexanone solution of polyvinyl butyral resin (Eslex BL-S, manufactured by Sekisui Chemical Co., Ltd.), and the mixture was dispersed by an ultrasonic dispersing machine for 1 hour. The dispersion thus obtained was coated on the above undercoat layer by a wire bar, and was dried at 110° C. under normal pressure for 1 hour to form a charge-generating layer having a thickness of 0.6 μm.

On the other hand, 100 parts of the following indane compound (charge-transporting agent No. 5) as a charge-transporting agent

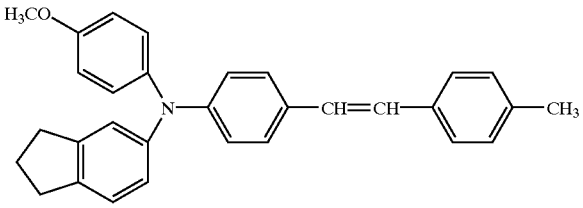

was added to 962 parts of a 13.0% tetrahydrofuran solution of polycarbonate resin No. 1, and the indane compound was completely dissolved by ultrasonic wave. The solution thus obtained was coated on the above charge-generating layer by a wire bar, and was dried at 110° C. under normal pressure for 30 minutes to form a charge-transporting layer having a thickness of 20 μm, thus producing a photoreceptor.

Example 10

A photoreceptor was produced in the same manner as in Example 9, except that polycarbonate resin No. 2 was used in place of polycarbonate resin No. 1 used in Example 9.

Example 11

A photoreceptor was produced in the same manner as in Example 9, except that X type metal free phthalocyanine (charge-generating agent No. 5) was used in place of charge-generating agent No. 4 and the following indane compound (charge-transporting agent No. 6) was used in place of charge-transporting agent No. 5.

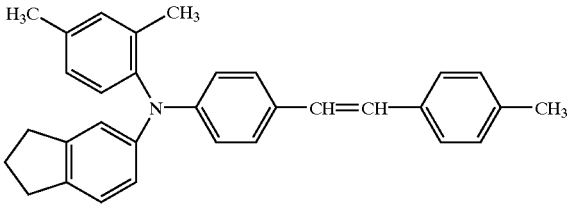

Example 12

A photoreceptor was produced in the same manner as in Example 11, except that polycarbonate resin No. 2 was used in place of polycarbonate resin No. 1 used in Example 11.

Example 13

A photoreceptor was produced in the same manner as in Example 3, except that the following indane compound (charge-transporting agent No. 7)

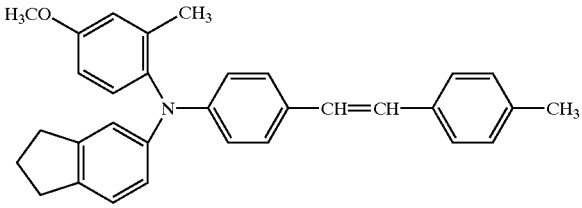

was used in place of charge-transporting agent No. 2 used in Example 3.

Example 14

A photoreceptor was produced in the same manner as in Example 13, except that a mixture of polycarbonate resin No. 2 and the following polycarbonate resin (polycarbonate resin No. 3) in a weight ratio of 8:2 was used in place of polycarbonate resin No. 1 used in Example 13.

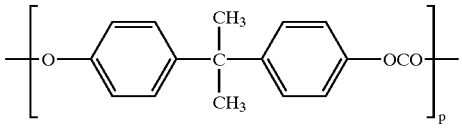

Example 15

A photoreceptor was produced in the same manner as in Example 1, except that the following polycarbonate resin (polycarbonate resin No. 4)

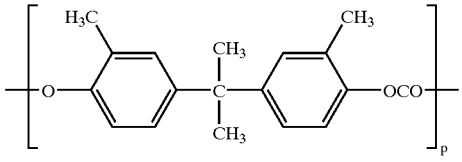

was used in place of polycarbonate resin No. 1 used in Example 1.

Example 16

A photoreceptor was produced in the same manner as in Example 1, except that the following polycarbonate resin (polycarbonate resin No. 5)

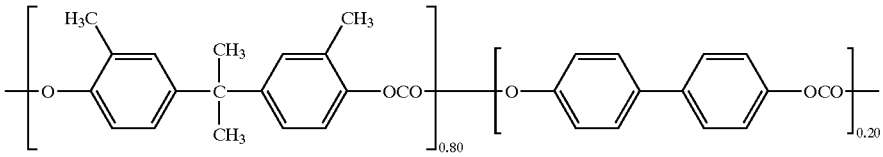

was used in place of polycarbonate resin No. 1 used in Example 1.

Example 17

A photoreceptor was produced in the same manner as in Example 1, except that the following polycarbonate resin (polycarbonate resin No. 6)

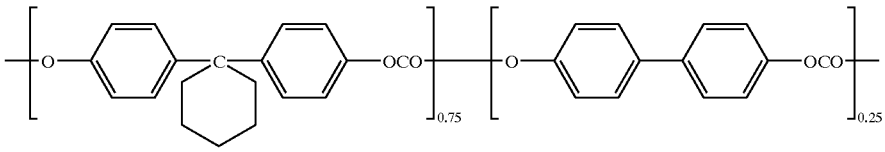

was used in place of polycarbonate resin No. 1 used in Example 1.

Example 18

A photoreceptor was produced in the same manner as in Example 3, except that a mixture of charge-transporting agent No. 2 and the following indane compound (charge-transporting agent No. 8) in a weight ratio of 8:2 was used in place of charge-transporting agent No. 2 used in Example 3.

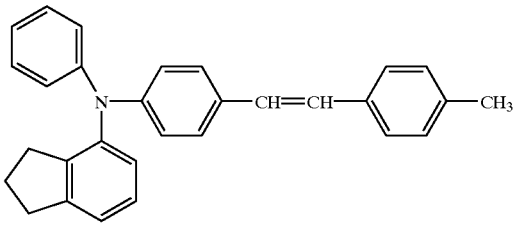

Example 19

A photoreceptor was produced in the same manner as in Example 18, except that polycarbonate resin No. 2 was used in place of polycarbonate resin No. 1 used in Example 18.

Example 20

A photoreceptor was produced in the same manner as in Example 7, except that a mixture of charge-transporting agent No. 4 and the following indane compound (charge-transporting agent No. 9) in a weight ratio of 8:2 was used in place of charge-transporting agent No. 4 used in Example 7.

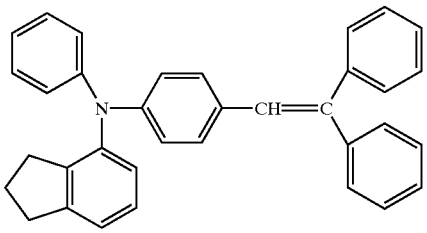

Example 21

A photoreceptor was produced in the same manner as in Example 20, except that polycarbonate resin No. 2 was used in place of polycarbonate resin No. 1 used in Example 20.

Example 22

1.0 Part of the following bisazo pigment (charge-generating agent No. 6) as a charge-generating agent

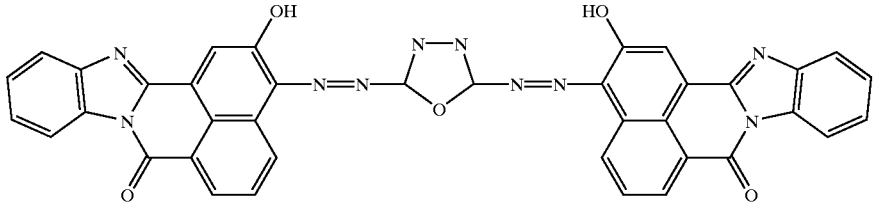

and 8.6 parts of a 5% cyclohexanone solution of polyvinyl butyral resin (Eslex BL-S, manufactured by Sekisui Chemical Co., Ltd.) were added to 83 parts of cyclohexanone, and the mixture was subjected to pulverization-dispersion treatment by a ball mill for 48 hours. The dispersion thus obtained was coated on an aluminum surface of an aluminum-vapor deposited PET film used as an electroconductive support, and was dried to form a charge-generating layer having a thickness of 0.8 μm. On the other hand, 100 parts of charge-transporting agent No. 2 as a charge-transporting agent was added to 962 parts of a 13.0% tetrahydrofuran solution of polycarbonate resin No. 5, and the indane compound was completely dissolved by ultrasonic wave. The solution thus obtained was coated on the above charge-generating layer by a wire bar, and was coated at 110° C. under normal pressure for 30 minutes to form a charge-transporting layer having a thickness of 20 μm, thus producing a photoreceptor.

Example 23

A photoreceptor was produced in the same manner as in Example 22, except that the following bisazo pigment (charge-generating agent No. 7)

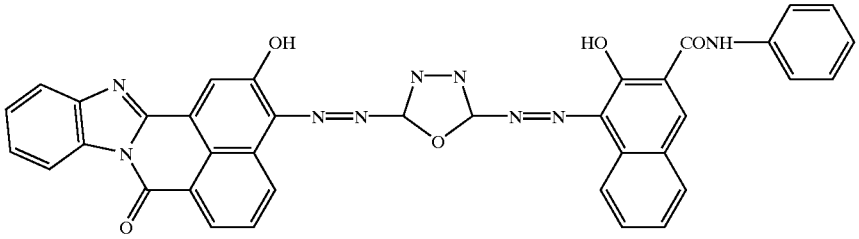

was used in place of charge-generating agent No. 6 used in Example 22.

Example 24

1.0 Part of the following bisazo pigment (charge-generating agent No. 8) as a charge-generating agent

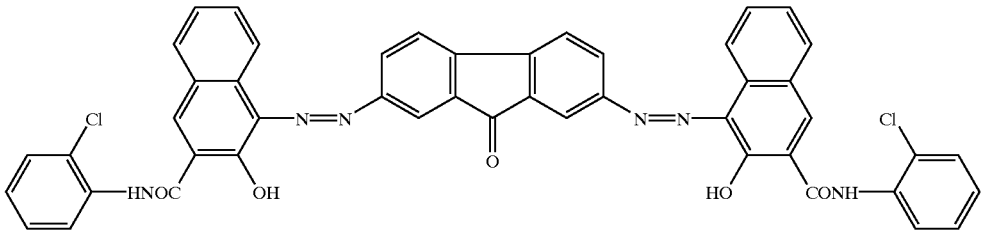

and 8.6 parts of a 5% tetrahydrofuran solution of polyester rein (Vylon 200, manufactured by Toyobo Co., Ltd.) were added to 83 parts of tetrahydrofuran, and the mixture was subjected to pulverization-dispersion treatment by a ball mill for 48 hours. The dispersion thus obtained was coated on an aluminum surface of an aluminum-vapor deposited PET film used as an electroconductive support, and was dried to form a charge-generating layer having a thickness of 0.8 μm. On the other hand, 100 parts of charge-transporting agent No. 7 as a charge-transporting agent was added to 962 parts of a 13.0% tetrahydrofuran solution of polycarbonate resin No. 2, and the indane compound was completely dissolved by ultrasonic wave. The solution thus obtained was coated on the above charge-generating layer by a wire bar, and was dried at 110° C. under normal pressure for 30 minutes to form a charge-transporting layer having a thickness of 20 μm, thus producing a photoreceptor.

Example 25

A photoreceptor was produced in the same manner as in Example 24, except that the following trisazo pigment (charge-generating agent No. 9)

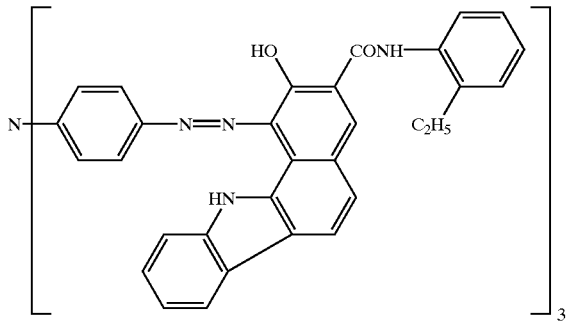

was used in place of charge-generating agent No. 8 used in Example 24.

Comparative Example 1

A photoreceptor was produced in the same manner as in Example 1, except that polycarbonate resin No. 3 was used in place of polycarbonate resin No. 1 used in Example 1.

Comparative Example 2

A photoreceptor was produced in the same manner as in Example 3, except that polycarbonate resin No. 3 was used in place of polycarbonate resin No. 1 used in Example 3.

Comparative Example 3

A photoreceptor was produced in the same manner as in Example 10, except that polycarbonate resin No. 3 was used in place of polycarbonate resin No. 2 used in Example 10.

Comparative Example 4

A photoreceptor was produced in the same manner as in Example 21, except that polycarbonate resin No. 3 was used in place of polycarbonate resin No. 2 used in Example 21.

Comparative Example 5

A photoreceptor was produced in the same manner as in Example 24, except that polycarbonate resin No. 3 was used in place of polycarbonate resin No. 2 used in Example 24.

Evaluation of Examples 1 to 21 and Comparative Examples 1 to 4

Evaluation of electrophotographic properties of photoreceptors produced in Examples 1 to 21 and Comparative Examples 1 to 4 was carried out by using an electrostatic copying test apparatus (tradename "EPA-8100"). The photoreceptors were subjected to corona discharge of −6.5 kV in the dark to measure a charge potential V0 at that time. Thereafter, the photoreceptors were subjected to light exposure with monocolor light of 780 nm at 1.0 $\mu$W/cm$^2$ to measure a half decay exposure amount E1/2 ($\mu$J/cm$^2$). Further, the photoreceptors were subjected to a rotary abrasion tester (manufactured by Toyo Seiki K. K.) having an abrasion ring CS-10 which is rotated 1,500 times to abrade the photoreceptors. The results are shown in the following Table 11.

TABLE 11

| Examples and Comparative Examples | Charge-generating agent No. | Charge-transporting agent No. | Polycarbonate resin No. | V0 (−V) | Vr (−V) | E1/2 ($\mu$J/cm$^2$) | Abrasion Amount (mg) |
|---|---|---|---|---|---|---|---|
| Example 1 | 1 | 1 | 1 | 738 | 0 | 0.31 | 5 |
| Example 2 | 1 | 1 | 2 | 721 | 0 | 0.37 | 8 |
| Example 3 | 2 | 2 | 1 | 635 | 1 | 0.46 | 5 |
| Example 4 | 2 | 2 | 2 | 612 | 2 | 0.49 | 8 |
| Example 5 | 3 | 3 | 1 | 724 | 1 | 0.39 | 4 |
| Example 6 | 3 | 3 | 2 | 702 | 1 | 0.41 | 8 |
| Example 7 | 3 | 4 | 1 | 703 | 1 | 0.41 | 4 |
| Example 8 | 3 | 4 | 2 | 687 | 2 | 0.44 | 7 |
| Example 9 | 4 | 5 | 1 | 746 | 11 | 0.61 | 4 |
| Example 10 | 4 | 5 | 2 | 725 | 13 | 0.65 | 8 |
| Example 11 | 5 | 6 | 1 | 815 | 14 | 0.60 | 4 |
| Example 12 | 5 | 6 | 2 | 802 | 11 | 0.65 | 7 |
| Example 13 | 2 | 7 | 1 | 638 | 3 | 0.44 | 3 |
| Example 14 | 2 | 7 | 2, 3 | 619 | 5 | 0.48 | 16 |
| Example 15 | 1 | 1 | 4 | 713 | 0 | 0.39 | 6 |
| Example 16 | 1 | 1 | 5 | 725 | 0 | 0.37 | 6 |
| Example 17 | 1 | 1 | 6 | 723 | 0 | 0.37 | 6 |
| Example 18 | 2 | 2, 8 | 1 | 622 | 2 | 0.47 | 6 |
| Example 19 | 2 | 2, 8 | 2 | 598 | 2 | 0.49 | 8 |
| Example 20 | 3 | 4, 9 | 1 | 689 | 1 | 0.42 | 5 |
| Example 21 | 3 | 4, 9 | 2 | 674 | 2 | 0.46 | 8 |
| Comparative Example 1 | 1 | 1 | 3 | 553 | 36 | 0.80 | 23 |
| Comparative Example 2 | 2 | 2 | 3 | 448 | 57 | 1.02 | 24 |
| Comparative Example 3 | 4 | 5 | 3 | 659 | 25 | 0.81 | 21 |
| Comparative Example 4 | 3 | 4, 9 | 3 | 452 | 62 | 0.99 | 25 |

Evaluation of Examples 22 to 25 and Comparative Example 5

Evaluation of electrophotographic properties of Examples 22 to 25 and Comparative Example 5 was carried out by using an electrostatic copying test apparatus (tradename "EPA-8100"). The photoreceptors were subjected to corona discharge of −6.0 kV in the dark to measure a charge potential V0 at that time. Thereafter, the photoreceptors were subjected to light exposure with white light of 1.0 lux to measure a half decay exposure amount E1/2 (lux·sec). Further, the photoreceptors were subjected to a rotary abrasion tester (manufactured by Toyo Seiki K. K.) having an abrasion ring CS-10 which is rotated 1,500 times to abrade the photoreceptors. The results are shown in the following Table 12.

TABLE 12

| Examples and Comparative Examples | Charge-generating agent No. | Charge-transporting agent No. | Polycarbonate resin No. | V0 (−V) | Vr (−V) | E1/2 (Lux · sec) | Abrasion Amount (mg) |
|---|---|---|---|---|---|---|---|
| Example 22 | 6 | 1 | 5 | 826 | 3 | 0.90 | 6 |
| Example 23 | 7 | 1 | 5 | 748 | 2 | 0.83 | 6 |

TABLE 12-continued

| Examples and Comparative Examples | Charge-generating agent No. | Charge-transporting agent No. | Polycarbonate resin No. | V0 (−V) | Vr (−V) | E1/2 (Lux · sec) | Abrasion Amount (mg) |
|---|---|---|---|---|---|---|---|
| Example 24 | 8 | 7 | 2 | 838 | 1 | 0.77 | 9 |
| Example 25 | 9 | 7 | 2 | 764 | 2 | 0.72 | 8 |
| Comparative Example 5 | 8 | 7 | 3 | 637 | 38 | 1.06 | 22 |

Example 26

1 Part by weight of an alcohol-soluble polyamide (Amilan CM-4000, manufactured by Toray Industries, Inc.) was dissolved in 13 parts by weight of methanol. 5 Parts by weight of titanium oxide (Tipaque CR-EL, manufactured by Ishihara Sangyo Kaisha, Ltd.) was added thereto, and the mixture was dispersed by a paint shaker for 8 hours to prepare a coating solution for an undercoat layer, and the coating solution thus prepared was coated on an aluminum surface of an aluminum-vapor deposited PET film by a wire bar and was dried to form an undercoat layer having a thickness of 1 $\mu$m.

Thereafter, 1.5 parts of titanyl phthalocyanine (charge-generating agent No. 1) having intensive peaks at diffraction angles (2θ±0.2°) of 9.6, 24.1 and 27.2 in Cu—Kα X-ray diffraction spectrum

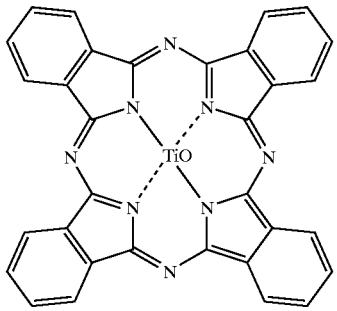

was added to 50 parts of a 3% cyclohexanone solution of polyvinyl butyral resin (Eslex BL-S, manufactured by Sekisui Chemical Co., Ltd.), and the mixture was dispersed by an ultrasonic dispersing machine for 1 hour. The dispersion thus obtained was coated on the above undercoat layer by a wire bar, and was dried at 110° C. under normal pressure for 1 hour to form a charge-generating layer having a film thickness of 0.6 $\mu$m.

On the other hand, 5.3 parts of Compound I-(6) as an additive and 100 parts of the following indane compound (charge-transporting agent No. 1) as a charge-transporting agent

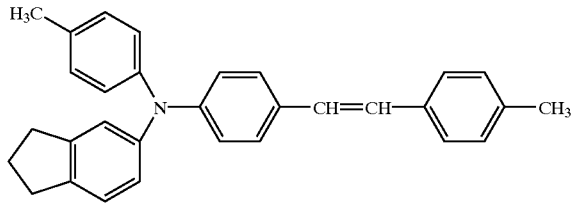

were added to 962 parts of a 13.0% tetrahydrofuran solution of polycarbonate resin (Iupilon Z, manufactured by Mitsubishi Engineering-Plastics Corporation) to have the additive and the indane compound completely dissolved by ultrasonic wave. The solution thus obtained was coated on the above charge-generating layer by a wire bar, and was dried at 110° C. under normal pressure for 30 minutes to form a charge-transporting layer having a film thickness of 20 $\mu$m, thus producing a photoreceptor.

Example 27

A photoreceptor was produced in the same manner as in Example 26, except that Compound III-(6) was used in place of Compound I-(6) used in Example 26.

Example 28

A photoreceptor was produced in the same manner as in Example 26, except that Compound IV-(8) was used in place of Compound I-(6) used in Example 26.

Example 29

A photoreceptor was produced in the same manner as in Example 26, except that Compound VI-(5) was used in place of Compound I-(6) used in Example 26.

Example 30

A photoreceptor was produced in the same manner as in Example 26, except that Compound X-(6) was used in place of Compound I-(6) used in Example 26.

Example 31

A photoreceptor was produced in the same manner as in Example 27, except that titanylphthalocyanine (charge-generating agent No. 2) having intensive peaks at diffraction angles (2θ±0.2°) of 7.5, 10.3, 12.6, 22.5, 24.3, 25.4 and 28.6 in Cu—Kα X-ray diffraction spectrum was used in place of charge-generating agent No. 1 and the following indane compound (charge-transporting agent No. 2) was used in place of charge-transporting agent No. 1.

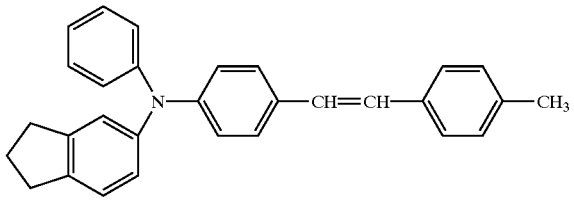

Example 32

A photoreceptor was produced in the same manner as in Example 31, except that Compound III-(10) was used in place of Compound III-(6) used in Example 31.

Example 33

A photoreceptor was produced in the same manner as in Example 27, except that titanylphthalocyanine (charge-generating agent No. 3) having intensive peaks at diffraction angles (2θ±0.2°) of 9.3, 10.6, 13.2, 15.1, 20.8, 23.3 and 26.3 in Cu—Kα X-ray diffraction spectrum was used in place of charge-generating agent No. 1 and the following indane compound (charge-transporting agent No. 3) was used in place of charge-transporting agent No. 1.

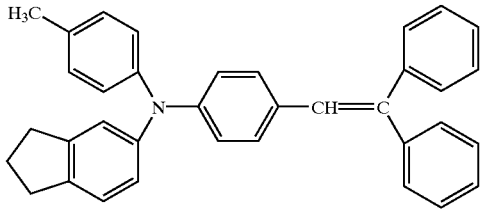

Example 34

A photoreceptor was produced in the same manner as in Example 33, except that Compound VI-(5) was used in place of Compound III-(6) used in Example 33.

Example 35

A photoreceptor was produced in the same manner as in Example 33, except that the following indane compound (charge-transporting agent No. 4) was used in place of charge-transporting agent No. 3 used in Example 33.

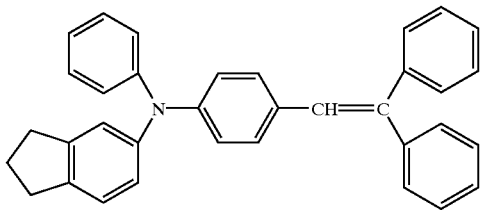

Example 36

A photoreceptor was produced in the same manner as in Example 35, except that Compound VI-(5) was used in place of Compound III-(6) used in Example 35.

Example 37

A photoreceptor was produced in the same manner as in Example 33, except that the following indane compound (charge-transporting agent No. 5)

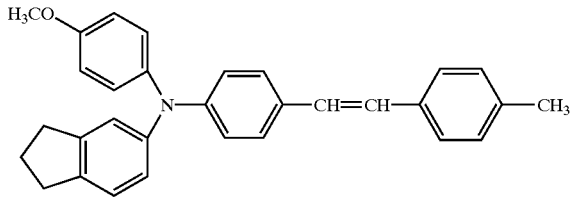

was used in place of charge-transporting agent No. 3 used in Example 33.

Example 38

10 Parts by weight of an alcohol-soluble polyamide (Amilan CM-8000, manufactured by Toray Industries, Inc.) was dissolved in 190 parts by weight of methanol, and the solution was coated on an aluminum surface of an aluminum-vapor deposited PET film by a wire bar and was dried to form an undercoat layer having a thickness of 1 μm. Thereafter, 1.5 parts of the following τ type metal free phthalocyanine (charge-generating agent No. 4) as a charge-generating agent

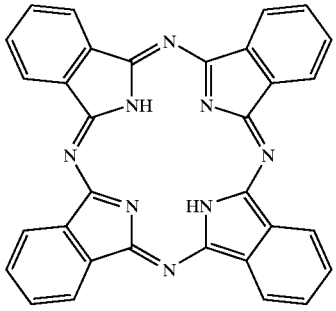

was added to 50 parts of a 3% cyclohexanone solution of polyvinyl butyral resin (Eslex BL-S, manufactured by Sekisui Chemical Co., Ltd.), and the mixture was dispersed by an ultrasonic dispersing machine for 1 hour. The dispersion thus obtained was coated on the above undercoat layer by a wire bar, and was dried at 110° C. under normal pressure for 1 hour to form a charge-generating layer having a thickness of 0.6 μm.

On the other hand, 5.3 parts of Compound VI-(5) as an additive and 100 parts of the following indane compound (charge-transporting agent No. 6) as a charge-transporting agent

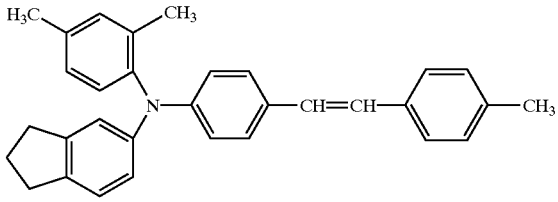

were added to 962 parts of a 13.0% tetrahydrofuran solution of polycarbonate resin (Iupilon Z, manufactured by Mitsubishi Engineering-Plastic Corporation), and the indane and the additive were completely dissolved by ultrasonic wave. The solution thus obtained was coated on the above charge-generating layer by a wire bar, and was dried at 110° C. under normal pressure for 30 minutes to form a charge-transporting layer having a thickness of 20 μm, thus producing a photoreceptor.

Example 39

A photoreceptor was produced in the same manner as in Example 38, except that X type metal free phthalocyanine (charge-generating agent No. 5) was used in place of charge generating agent No. 4, and the following indane compound (charge-transporting agent No. 7)

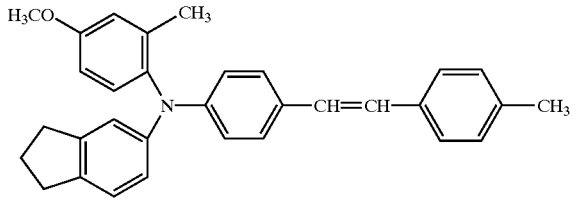

was used in place of charge-transporting agent No. 6 used in Example 38.

Example 40

A photoreceptor was produced in the same manner as in Example 31, except that a mixture of charge-transporting agent No. 2 and the following indane compound (charge-transporting agent No. 8) in a weight ratio of 8:2 was used in place of charge-transporting agent No. 2 used in Example 31.

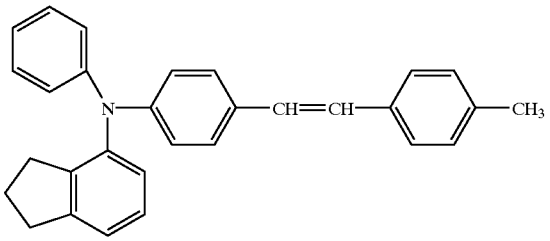

Example 41

A photoreceptor was produced in the same manner as in Example 40, except that Compound VI-(5) was used in place of Compound III-(6) used in Example 40.

Example 42

A photoreceptor was produced in the same manner as in Example 35, except that a mixture of charge-transporting agent No. 4 and the following indane compound (charge-transporting agent No. 9) in a weight ratio of 8:2 was used in place of charge-transporting agent No. 4 used in Example 35.

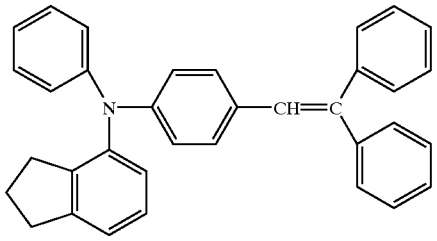

Example 43

A photoreceptor was produced in the same manner as in Example 42, except that Compound VI-(5) was used in place of Compound III-(6) used in Example 42.

Example 44

1.0 Part of the following bisazo pigment (charge-generating agent No. 6) as a charge-generating agent

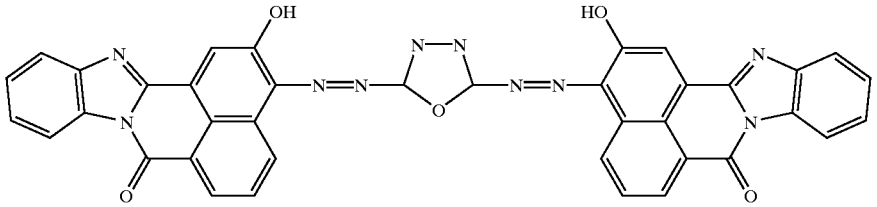

and 8.6 parts of a 5% cyclohexanone solution of polyvinyl butyral resin (Eslex BL-S, manufactured by Sekisui Chemical Co., Ltd.) were added to 83 parts of cyclohexanone, and the mixture was subjected to pulverization-dispersion treatment by a ball mill for 48 hours. The dispersion thus obtained was coated on an aluminum surface of an aluminum-vapor deposited PET film used as an electroconductive support, and was dried to form a charge-generating layer having a thickness of 0.8 μm. On the other hand, 5.3 parts of Compound III-(6) as an additive and 100 parts of charge-transporting agent No. 7 as a charge-transporting agent were added to 962 parts of a 13.0% tetrahydrofuran solution of polycarbonate resin (Iupilon Z, manufactured by Mitsubishi Engineering-Plastics Corporation), and the additive and the indane compound were completely dissolved by ultrasonic wave. The solution thus obtained was coated on the above charge-generating layer by a wire bar, and was coated at 110° C. under normal pressure for 30 minutes to form a charge-transporting layer having a thickness of 20 μm, thus producing a photoreceptor.

Example 45

A photoreceptor was produced in the same manner as in Example 44, except that the following bisazo pigment (charge-generating agent No. 7)

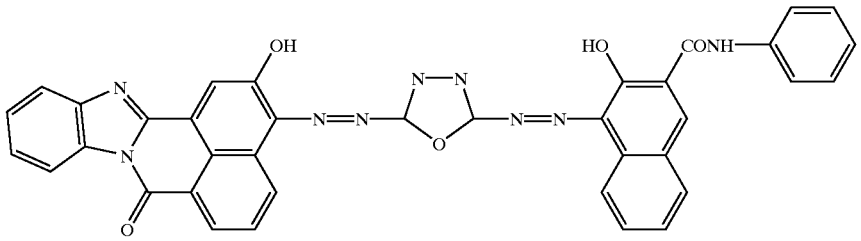

was used in place of charge-generating agent No. 6 used in Example 44.

Example 46

1.0 Part of the following bisazo pigment (charge-generating agent No. 8) as a charge-generating agent

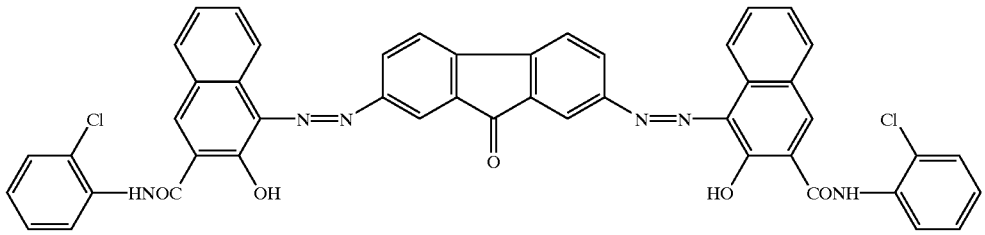

and 8.6 parts of a 5% tetrahydrofuran solution of polyester rein (Vylon 200, manufactured by Toyobo Co., Ltd.) were added to 83 parts of tetrahydrofuran and the mixture was subjected to pulverization-dispersion treatment by a ball mill for 48 hours. The dispersion thus obtained was coated on an aluminum surface of an aluminum-vapor deposited PET film used as an electroconductive support, and was dried to form a charge-generating layer having a thickness of 0.8 $\mu$m. On the other hand, 5.3 parts of Compound III-(6) as an additive and 100 parts of charge-transporting agent No. 1 as a charge-transporting agent were added to 962 parts of a 13.0% tetrahydrofuran solution of polycarbonate resin (Iupilon Z, manufactured by Mitsubishi Engineering-Plastics Corporation), and the indane compound was completely dissolved by ultrasonic wave. The solution thus obtained was coated on the above charge-generating layer by a wire bar, and was dried at 110° C. under normal pressure for 30 minutes to form a charge-transporting layer having a thickness of 20 $\mu$m, thus producing a photoreceptor.

Example 47

A photoreceptor was produced in the same manner as in Example 46, except that the following trisazo pigment (charge-generating agent No. 9)

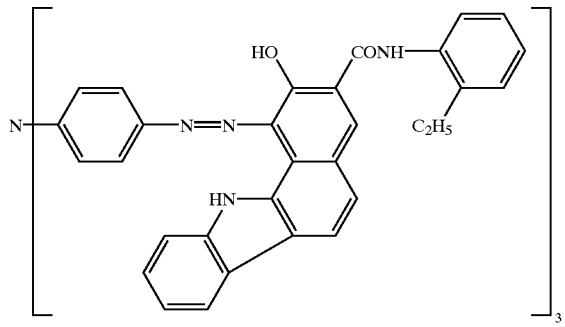

was used in place of charge-generating agent No. 8 used in Example 46.

Comparative Example 6

A photoreceptor was produced in the same manner as in Example 26, except that Compound I-(6) was omitted.

Comparative Example 7

A photoreceptor was produced in the same manner as in Example 31, except that Compound III-(6) was omitted.

Comparative Example 8

A photoreceptor was produced in the same manner as in Example 42, except that Compound III-(6) was omitted.

Comparative Example 9

A photoreceptor was produced in the same manner as in Example 44, except that Compound III-(6) was omitted.

Evaluation of Examples 26 to 43 and Comparative Examples 6 to 8

Evaluation of electrophotographic properties of photoreceptors produced in Examples 26 to 43 and Comparative Examples 6 to 8 was carried out by using a photosensitive drum property-measuring apparatus (tradename "ELYSIA-II", manufactured by Trec Japan K. K.). The photoreceptors were subjected to corona discharge of −5.5 kV in the dark and an erase lamp of 70 lux was put on to measure a charge potential V0 at that time. Thereafter, the photoreceptors were subjected to light exposure with monocolor light of 780 nm −30 μW image exposure to measure a residual potential Vr. Further, the photoreceptors were exposed in an ozone gas of 20 ppm in a room under a fluorescent light for 5 days to measure a charge potential V0 and a residual potential Vr in the same manner as in before the exposure. The results are shown in Table 13.

TABLE 13

| Examples and Comparative Examples | Charge-generating agent | Charge-Transporting agent | Additive No. | Charge potential V0 (−V) Before exposing to ozone gas | Charge potential V0 (−V) After exposing to ozone gas | Residual potential Vr (−V) Before exposing to ozone gas | Residual potential Vr (−V) After exposing to ozone gas |
|---|---|---|---|---|---|---|---|
| Example 26 | 1 | 1 | I - (6) | 649 | 626 | 8 | 13 |
| Example 27 | 1 | 1 | III - (6) | 680 | 645 | 13 | 20 |
| Example 28 | 1 | 1 | IV - (8) | 638 | 620 | 5 | 15 |
| Example 29 | 1 | 1 | VI - (5) | 647 | 641 | 18 | 23 |
| Example 30 | 1 | 1 | X - (6) | 690 | 639 | 16 | 20 |
| Example 31 | 2 | 2 | III - (6) | 590 | 562 | 28 | 32 |
| Example 32 | 2 | 2 | III - (10) | 578 | 560 | 22 | 26 |
| Example 33 | 3 | 3 | III - (6) | 682 | 650 | 20 | 24 |
| Example 34 | 3 | 3 | VI - (5) | 670 | 641 | 22 | 26 |
| Example 35 | 3 | 4 | III - (6) | 690 | 659 | 20 | 25 |
| Example 36 | 3 | 4 | VI - (5) | 680 | 650 | 20 | 26 |
| Example 37 | 3 | 5 | III - (6) | 685 | 652 | 19 | 25 |
| Example 38 | 4 | 6 | VI - (5) | 710 | 685 | 41 | 47 |
| Example 39 | 5 | 7 | VI - (5) | 770 | 740 | 43 | 41 |
| Example 40 | 2 | 2, 8 | III - (6) | 580 | 558 | 29 | 34 |
| Example 41 | 2 | 2, 8 | VI - (5) | 569 | 543 | 25 | 30 |
| Example 42 | 3 | 4, 9 | III - (6) | 681 | 650 | 22 | 26 |
| Example 43 | 3 | 4, 9 | VI - (5) | 669 | 640 | 20 | 25 |
| Comparative Example 6 | 1 | 1 | — | 626 | 470 | 6 | 72 |
| Comparative Example 7 | 2 | 2 | — | 595 | 439 | 24 | 68 |
| Comparative Example 8 | 3 | 4, 9 | — | 620 | 430 | 20 | 76 |

Evaluation of Examples 44 to 47 and Comparative Example 9

Evaluation of electrophotographic properties of photoreceptors produced in Examples 44 to 47 and Comparative Example 9 was carried out by using a photosensitive drum property-measuring apparatus (tradename "ELYSIA-II", manufactured by Trec Japan K. K.). The photoreceptors were subjected to corona discharge of −4.8 kV in the dark and an erase lamp of 70 lux was put on to measure a charge potential V0 at that time. Thereafter, the photoreceptors were subjected to light exposure with white light of 40 lux image exposure to measure a residual potential Vr. Further, the photoreceptors were exposed in an ozone gas of 20 ppm in a room under a fluorescent light for 5 days to measure a charge potential V0 and a residual potential Vr in the same manner as in before the exposure. The results are shown in Table 14.

TABLE 14

| Examples and Comparative Examples | Charge-generating agent | Charge-Transporting agent | Additive No. | Charge potential V0 (−V) Before exposing to ozone gas | Charge potential V0 (−V) After exposing to ozone gas | Residual potential Vr (−V) Before exposing to ozone gas | Residual potential Vr (−V) After exposing to ozone gas |
|---|---|---|---|---|---|---|---|
| Example 44 | 6 | 7 | III - (6) | 730 | 705 | 26 | 32 |
| Example 45 | 7 | 7 | III - (6) | 712 | 670 | 21 | 27 |
| Example 46 | 8 | 1 | III - (6) | 735 | 695 | 11 | 23 |

TABLE 14-continued

| Examples and Comparative Examples | Charge-generating agent | Charge-Transporting agent | Additive No. | Charge potential V0 (−V) Before exposing to ozone gas | Charge potential V0 (−V) After exposing to ozone gas | Residual potential Vr (−V) Before exposing to ozone gas | Residual potential Vr (−V) After exposing to ozone gas |
|---|---|---|---|---|---|---|---|
| Example 47 | 9 | 1 | III - (6) | 705 | 656 | 16 | 22 |
| Comparative Example 9 | 6 | 7 | — | 740 | 505 | 10 | 59 |

As mentioned above, according to the present invention, by combining an indane compound having a specific structure as a charge-transporting agent and a polycarbonate resin having a specific structure as a binder resin, an electrophotographic photoreceptor having a sensitivity and electrophotographic properties improved and having an excellent durability can be provided.

Also, according to the present invention, by combining an indane compound having a specific structure as a charge-transporting agent and an organic additive having a specific structure, an electrophotographic photoreceptor having an excellent durability, in which a change in a charge potential and a residual potential is small, can be provided.

Obviously, numerous modifications and variations of the present invention are possible in light of the above teachings. It is therefore to be understood that within the scope of the appended claims, the invention may be practiced otherwise than as specifically described herein.

The entire disclosures of Japanese Patent Application No. 2001-297317 filed on Sep. 27, 2001 and Japanese Patent Application No. 2001-333180 filed on Oct. 30, 2001 including specifications, claims, drawings and summaries are incorporated herein by reference in their entireties.

What is claimed is:

1. An electrophotographic photoreceptor having at least one indane compound of the following formula (1) and at least one polycarbonate resin of the following formula (4) in a weight ratio of from 2:8 to 7:3 on an electroconductive support;

said at least one indane compound being expressed by the formula (1), (1)

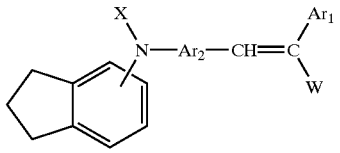

(wherein Ar1 is a substituted or unsubstituted aryl group, Ar2 is a substituted or unsubstituted phenylene group, a substituted or unsubstituted naphthylene group, a substituted or unsubstituted biphenylene group or a substituted or unsubstituted anthrylene group, W is a hydrogen atom, a substituted or unsubstituted alkyl group or a substituted or unsubstituted aryl group, X is a substituted or unsubstituted aryl group, a monovalent group of the formula (2), (2)

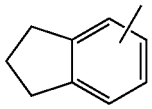

or a monovalent group of the formula (3), (3)

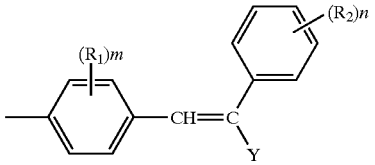

(wherein R1 is a hydrogen atom, a lower alkyl group or a lower alkoxy group, R2 is a hydrogen atom, a halogen atom or a lower alkyl group, Y is a hydrogen atom or a substituted or unsubstituted aryl group, and m and n are an integer of from 0 to 4)), and said at least one polycarbonate resin being expressed by the formula (4), (4)

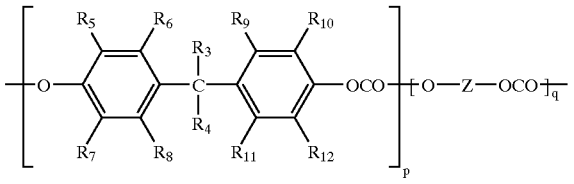

(wherein R3 and R4 are respectively independently a hydrogen atom, a substituted or unsubstituted alkyl group or a substituted or unsubstituted aryl group, R3 and R4 together may form a ring, R5, R6, R7, R8, R9, R10, R11 and R12 are respectively independently a hydrogen atom, a substituted or unsubstituted alkyl group, a substituted or unsubstituted aryl group or a halogen atom, p is a positive integer, q is 0 or a positive integer, p and q satisfy the formula $0 \leqq q/p \leqq 2$, Z is a substituted or unsubstituted $C_1$–$C_5$ alkylene group, a substituted or unsubstituted 4,4'-biphenylene group or a divalent group of the formula (5), (5)

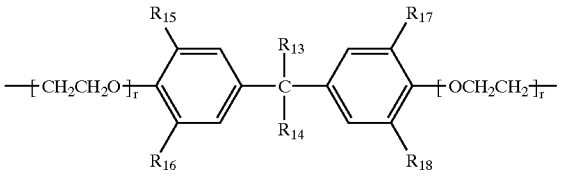

(wherein R13 and R14 are respectively independently a hydrogen atom, a substituted or unsubstituted alkyl group or a substituted or unsubstituted aryl group, R13 and R14 together may form a ring, R15, R16, R17 and R18 are respectively independently a hydrogen atom, a substituted or unsubstituted alkyl group, a substituted or unsubstituted aryl group or a halogen atom, and r is 0 or an integer of from 1 to 3)), provided that when only one kind of polycarbonate resin is used, the polycarbonate resin of the formula (4) does not have a structure wherein R3 and R4 are a methyl group, R5, R6, R7, R8, R9, R10, R11 and R12 are a hydrogen atom, and q is 0.

2. The electrophotographic photoreceptor according to claim 1, wherein said at least one polycarbonate resin of the formula (4) is at least one polycarbonate resin of the following structural formulae;

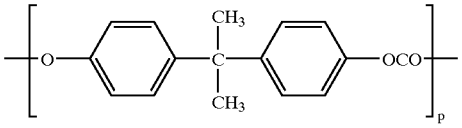

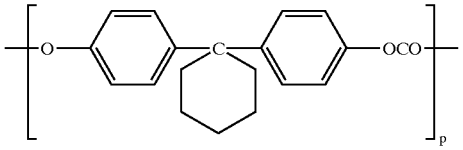

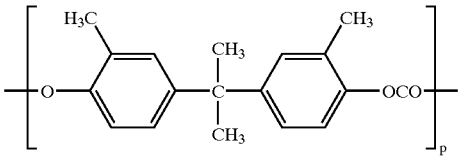

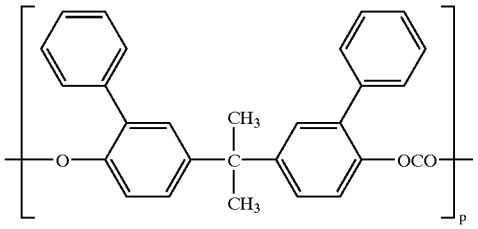

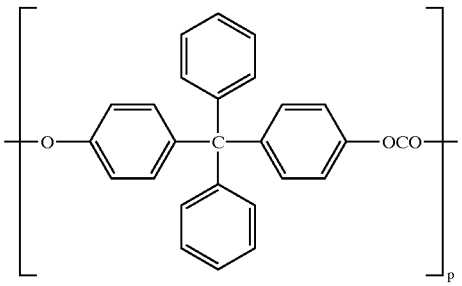

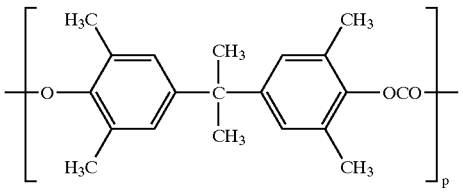

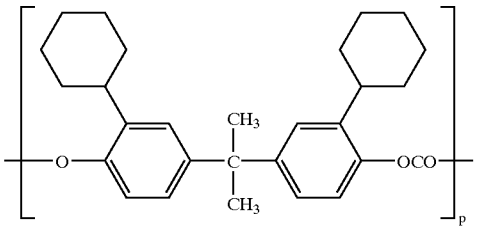

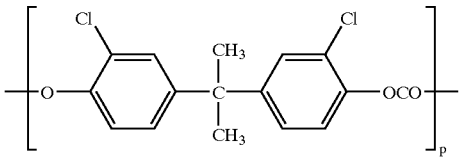

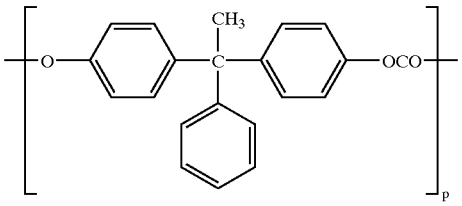

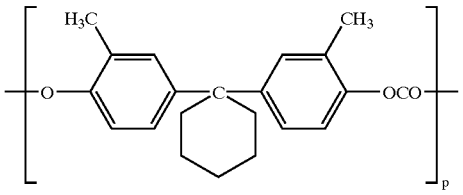

-continued
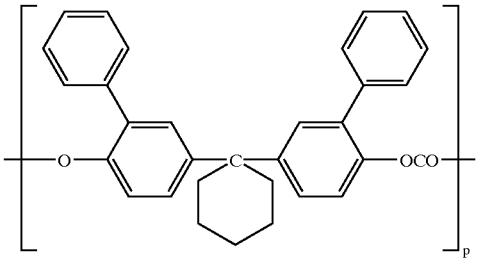
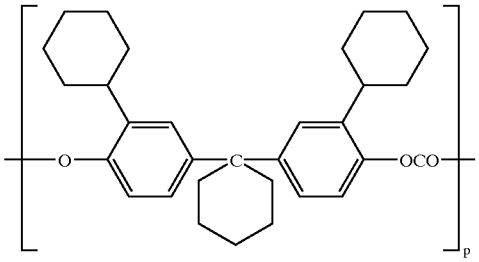
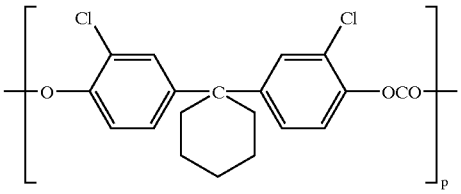
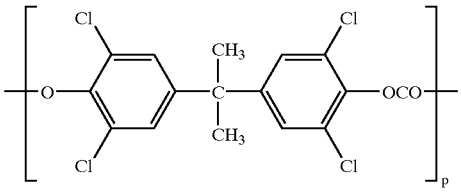
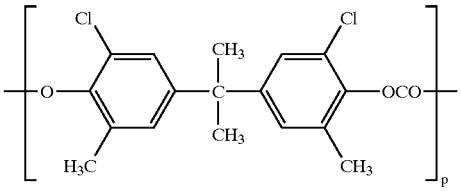
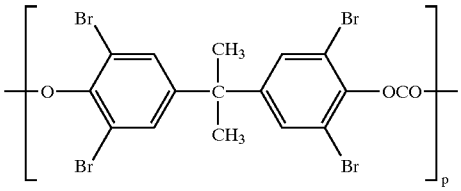
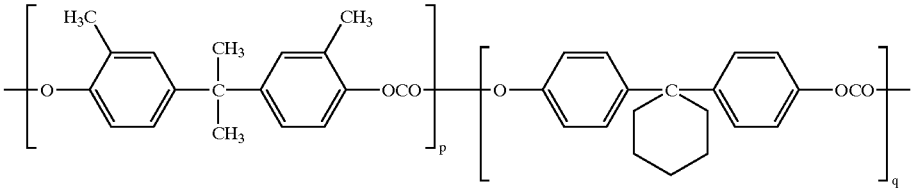
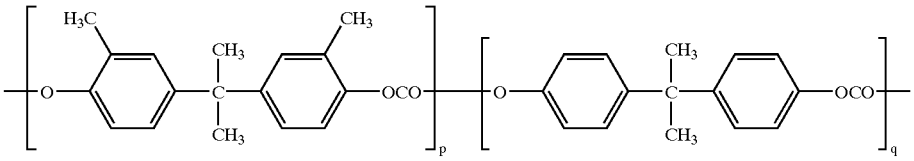
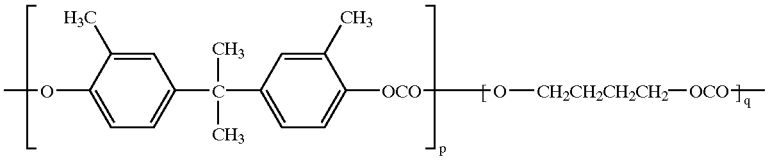
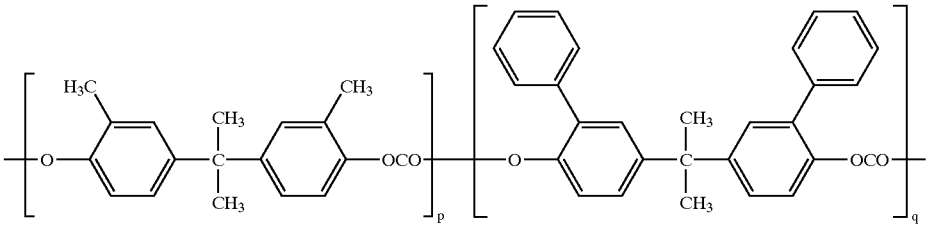
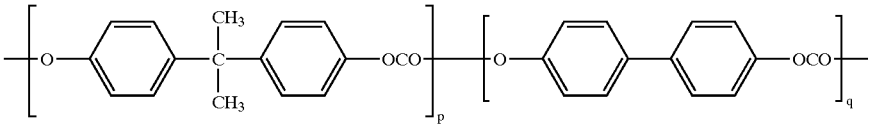
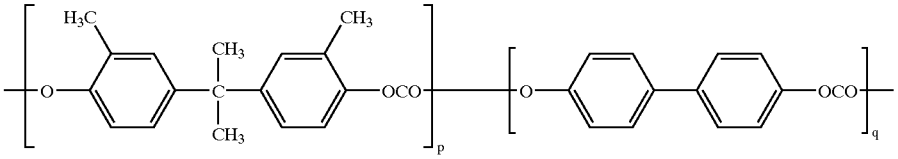

-continued

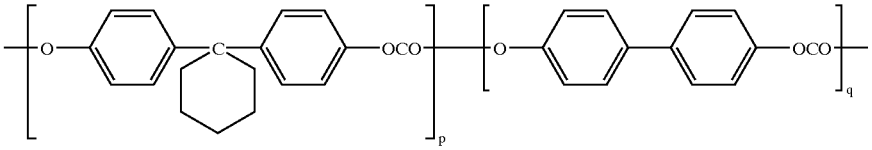

3. The electrophotographic photoreceptor according to claim 1, wherein the weight ratio of said at least one indane compound of the formula (1) and said at least one polycarbonate resin of the formula (4) is from 3:7 to 6:4.

4. The electrophotographic photoreceptor according to claim 2, wherein the weight ratio of said at least one indane compound of the formula (1) and said at least one polycarbonate resin of the formula (4) is from 3:7 to 6:4.

5. An electrophotographic photoreceptor having a photosensitive layer containing at least one indane compound of the following formula (1) and an organic additive containing at least one atom selected from the group consisting of nitrogen, oxygen, phosphorus and sulfur for an electrophotographic photoreceptor on an electroconductive support;

said at least one indane compound being expressed by the formula (1), (1)

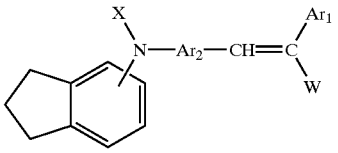

(wherein Ar1 is a substituted or unsubstituted aryl group, Ar2 is a substituted or unsubstituted phenylene group, a substituted or unsubstituted naphthylene group, a substituted or unsubstituted biphenylene group or a substituted or unsubstituted anthrylene group, W is a hydrogen atom, a substituted or unsubstituted alkyl group or a substituted or unsubstituted aryl group, X is a substituted or unsubstituted aryl group, a monovalent group of the formula (2), (2)

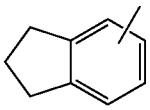

or a monovalent group of the formula (3), (3)

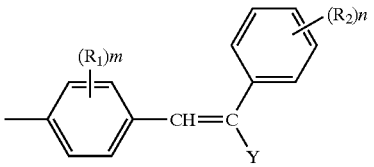

(wherein R1 is a hydrogen atom, a lower alkyl group or a lower alkoxy group, R2 is a hydrogen atom, a halogen atom or a lower alkyl group, Y is a hydrogen atom or a substituted or unsubstituted aryl group, and m and n are an integer of from 0 to 4)).

6. The electrophotographic photoreceptor according to claim 5, wherein the organic additive containing at least one atom selected from the group consisting of nitrogen, oxygen, phosphorus and sulfur for an electrophotographic photoreceptor is contained in an amount of from 0.05 to 30 wt % to the indane compound of the formulae (1) to (3);

the organic additive being at least one compound selected from the group consisting of an organic phosphite compound of the formula (6), (6)

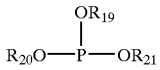

(wherein $R_{19}$, $R_{20}$ and $R_{21}$ may be the same or different, and are a hydrogen atom, a substituted or unsubstituted alkyl group, a substituted or unsubstituted alkenyl group, an allyl group or a substituted or unsubstituted aryl group, provided that $R_{19}$, $R_{20}$ and $R_{21}$ are not hydrogen atoms at the same time), a triphenylated phosphorus compound of the formula (7), (7)

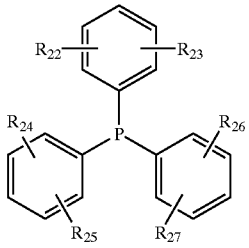

(wherein $R_{22}$, $R_{23}$, $R_{24}$, $R_{25}$, $R_{26}$ and $R_{27}$ may be the same or different, and are a hydrogen atom, a halogen atom, a hydroxyl group, an amino group or an alkyl group), a thioether compound of the formula (8), $$R_{28}—S—R_{29} \quad (8)$$

wherein $R_{28}$ and $R_{29}$ may be the same or different, and are a substituted or unsubstituted alkyl group, a substituted or unsubstituted alkenyl group, an allyl group or a substituted or unsubstituted aryl group), a hydroquinone compound of the formula (9), (9)

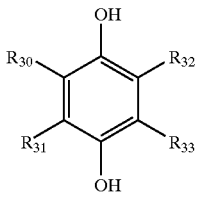

(wherein $R_{30}$, $R_{31}$, $R_{32}$ and $R_{33}$ may be the same or different, and are a hydrogen atom, a substituted or unsubstituted alkyl group, a substituted or unsubstituted alkenyl group, an allyl group or a substituted or unsubstituted aryl group), a benzotriazole compound of the formula (10), (10)

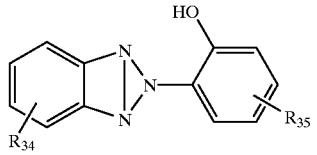

(wherein $R_{34}$ and $R_{35}$ may be the same or different, and are a hydrogen atom, a substituted or unsubstituted alkyl group, a substituted or unsubstituted alkenyl group, an allyl group or a substituted or unsubstituted aryl group), a benzotriazole-alkylenebisphenol compound of the formula (11), (11)

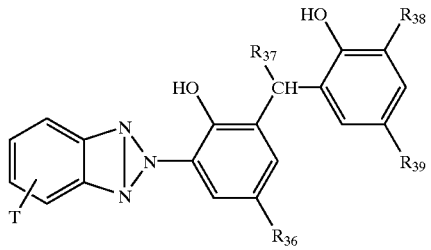

(wherein T is a hydrogen atom, a halogen atom, an alkyl group, a cycloalkyl group, an alkoxy group or an aralkyl group, $R_{36}$ is an alkyl group, a cycloalkyl group, an aryl group, an alkoxy group or an aralkyl group, $R_{37}$ is a hydrogen atom, an alkyl group or an aryl group, $R_{38}$ and $R_{39}$ may be the same or different and are an alkyl group, a cycloalkyl group, an aryl group or an aralkyl group), a hydroxybenzophenone compound of the formula (12), (12)

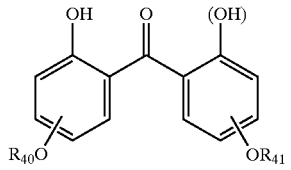

(wherein $R_{40}$ and $R_{41}$ may be the same or different, and are a hydrogen atom, a substituted or unsubstituted alkyl group, a substituted or unsubstituted alkenyl group, an allyl group or a substituted or unsubstituted aryl group), hindered phenol compounds of the formulae (13) and (14), (13)

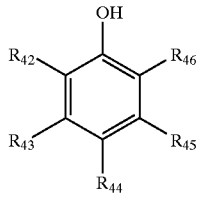

(wherein $R_{42}$ is a lower alkyl group, $R_{43}$, $R_{44}$, $R_{45}$ and $R_{46}$ may be the same or different, and are a hydrogen atom, a substituted or unsubstituted lower alkyl group or a substituted or unsubstituted lower alkoxy group), (14)

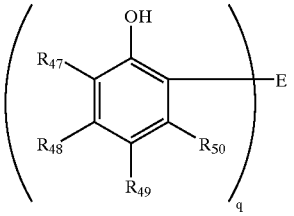

(wherein $R_{47}$ is a lower alkyl group, $R_{48}$, $R_{49}$ and $R_{50}$ may be the same or different, and are a hydrogen atom, a substituted or unsubstituted lower alkyl group or a substituted or unsubstituted lower alkoxy group, q is an integer of from 2 to 4, E is an oxygen atom or an aliphatic divalent group when q=2 and is an aliphatic trivalent group or an aromatic trivalent group when q=3, and an aliphatic tetravalent group when q=4), a hindered amine compound of the formula (15), (15)

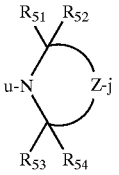

(wherein $R_{51}$, $R_{52}$, $R_{53}$ and $R_{54}$ may be the same or different, and are a hydrogen atom, a substituted or unsubstituted alkyl group or a substituted or unsubstituted aryl group, Z is a group of atoms necessary for forming a nitrogen-containing heterocyclic ring, and one of a pair of $R_{51}$ and $R_{52}$ and a pair of $R_{53}$ and $R_{54}$ may form a double bond within Z, and u and j are organic residues), and a salicylate compound of the formula (16), (16)

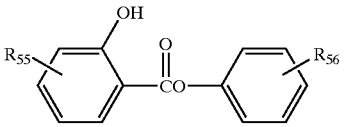

(wherein $R_{55}$ and $R_{56}$ may be the same or different, and are a hydrogen atom, a substituted or unsubstituted alkyl group, a substituted or unsubstituted alkenyl group, an allyl group or a substituted or unsubstituted aryl group).

7. The electrophotographic photoreceptor according to claim 6, wherein the organic additive of the formulae (6) to (16) for an electrophotographic photoreceptor is contained in an amount of from 0.1 to 20 wt % to the indane compound of the formulae (1) to (3).

8. The electrophotographic photoreceptor according to claim 5, wherein the organic additive of the formulae (6) to (16) for an electrophotographic photoreceptor is contained in an amount of from 0.1 to 20 wt % to the indane compound of the formulae (1) to (3).

* * * * *